US011545353B2

(12) United States Patent
Cooks et al.

(10) Patent No.: US 11,545,353 B2
(45) **Date of Patent: *Jan. 3, 2023**

(54) LOGICAL OPERATIONS IN MASS SPECTROMETRY

(71) Applicant: Purdue Research Foundation, West Lafayette, IN (US)

(72) Inventors: Robert Graham Cooks, West Lafayette, IN (US); Dalton Snyder, West Lafayette, IN (US); Lucas Szalwinski, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/401,774

(22) Filed: Aug. 13, 2021

(65) Prior Publication Data

US 2021/0375612 A1 Dec. 2, 2021

Related U.S. Application Data

(63) Continuation of application No. 17/040,721, filed as application No. PCT/US2019/022721 on Mar. 18, 2019, now Pat. No. 11,127,581.

(60) Provisional application No. 62/647,189, filed on Mar. 23, 2018.

(51) Int. Cl.
*H01J 49/42* (2006.01)

(52) U.S. Cl.
CPC ..... *H01J 49/4225* (2013.01); *H01J 49/428* (2013.01); *H01J 49/429* (2013.01)

(58) Field of Classification Search
CPC .... H01J 49/4225; H01J 49/428; H01J 49/429; H01J 49/40; H01J 49/34; H01J 49/42; H01J 49/4215
USPC ..... 250/281, 282, 283
See application file for complete search history.

(56) References Cited

U.S. PATENT DOCUMENTS

| | | | | |
|---|---|---|---|---|
| 5,644,131 | A | 7/1997 | Hansen | |
| 6,838,666 | B2 | 1/2005 | Ouyang et al. | |
| 7,335,897 | B2 | 2/2008 | Takats et al. | |
| 8,304,718 | B2 | 11/2012 | Ouyang et al. | |
| 10,580,633 | B2 | 3/2020 | Cooks et al. | |
| 10,622,202 | B2 | 4/2020 | Cooks et al. | |
| 11,127,581 | B2 * | 9/2021 | Cooks | H01J 49/428 |
| 2012/0119079 | A1 | 5/2012 | Ouyang et al. | |

FOREIGN PATENT DOCUMENTS

WO 2009/102766 A1 8/2009

OTHER PUBLICATIONS

Bonner, 1977, The Cylindrical Ion Trap, International Journal of Mass Spectrometry and Ion Physics, 24(3):255-269.

(Continued)

*Primary Examiner* — Nicole M Ippolito
(74) *Attorney, Agent, or Firm* — Brown Rudnick LLP; Adam M. Schoen

(57) ABSTRACT

The invention generally relates to logical operations in mass spectrometry. The system comprising a mass spectrometer comprising one or more ion traps; and a central processing unit (CPU), and storage coupled to the CPU for storing instructions that when executed by the CPU cause the system to apply one or more scan functions to the one or more ion traps, the scan functions being combine together.

11 Claims, 23 Drawing Sheets

(56) References Cited

OTHER PUBLICATIONS

Carroll, 1975, Atmospheric Pressure Ionization Mass Spectrometry: Corona Discharge Ion Source for Use in Liquid Chromatograph-Mass Spectrometer-Computer Analytical System, Anal. Chem. 47:2369-2373.
Cody, 2005, Versatile New Ion Source for the Analysis of Materials in Open Air under AMbient Conditions, Anal Chem, 77:2297-2302.
Fenn, 1989, Electrospray Ionization for Mass Spectrometry of Large Biomolecules, Science, 246:64-71.
Gao, 2006, Handheld Rectilinear Ion Trap Mass Spctrometer, Anal. Chem., 78, 5994-6002.
Gao, 2008, Design and Characterization of a Multisource Hand-Held Tandem Mass Spectrometer, Anal. Chem. 80:7198-7205.
Guo, 2016, Diisopropylethylamine/hexafluoroisopropanol-mediated ion-pairing ultra-high-performance liquid chromatography/mass spectrometry for phosphate and carboxylate metabolite analysis: utility for studying cellular metabolism, Rapid Commun., Mass Spectrum, 2016, 30(16):1835-1845.
Hagar, 2002, A new linear ion trap mass spectrometer, Rapid Communications in Mass Spectrometry, 16(6):512-526.
Hendricks, 2014, Autonomous in-situ analysis and real-time chemical detection using a backpack minature mass spectrometer: concept, instrumentation development, and performance, Anal. Chem., 86, 2900-2908.
Hou, 2011, Sampling Wand for an Ion Trap Mass Spectrometer, Anal. Chem, 83:1857-1861.
Kogelschatz, 2003, Plasma Chemistry and Plasma Processing, 23:1-46.
Laiko, 2000, Atmospheric pressure matrix-assisted laser desorption/ionization mass spectrometry, Anal. Chem., 72:652-657.
Li, 2014, Miniature Ambient Mass Analysis System, Anal. Chem., 86:2909-2916.
Shiea, 2005, Electrospray-assisted laser desorption/ionization mass spectrometry for direct ambient analysis of solids, J. Rapid Communications in Mass Spectrometry, 19:3701-3704.
Snyder, 2016, Linear mass scans in quadrupole ion traps using the inverse Mathieu q scan, Rapid Commun. Mass Spectrom., 30:2369-2378.
Snyder, 2017, Simultaneous ad Sequential MS/MS Scan Combinations and Permutations in a Linear Quadrupole Ion Trap, Analytical Chemisrty, 89(20):11053-11060.
Takats, 2004, Mass Spectrometry Sampling Under Ambient Conditions with Desorption Electrospray Ionization, Science, 306:471-473.
Tanaka, 1988, Protein and polymer analyses up to m/z 100 000 by laser ionization time-of-flight mass spectrometry, Rapid Commun. Mass Spectrom., 2:151-153.
Yamashita, 1984, Electrospray Ion Source. Another Variation on the Free-Jet Theme, J. Phys. Chem., 88:4451-4459.

* cited by examiner

DON'T DRAW

Table 1A: Proposed logical MS/MS operations, terminology, symbolism, and interpretation for existing operations

| | | | |
|---|---|---|---|
| Product Ion | ● *m/z* 188<br>↓<br>○ | N/A | Detects product ions of a mass-selected precursor ion |
| Precursor Ion | ○<br>↓<br>● *m/z* 188 | N/A | Detects precursor ions of a mass-selected product ion |
| Neutral Loss | ○<br>↓ 148 Da<br>○ | N/A | Detects precursor ions that fragment to product ions with a selected (fixed) mass offset from the precursor ions; a subset of the functional relationship scans |
| Functional Relationship | ○<br>↓<br>○ | N/A | Detects precursor ions whose product ions satisfy a given mathematical relationship, e.g., product ions whose *m/z* is half the precursor ion *m/z* |
| Single/Multiple Reaction Monitoring | ● *m/z* 337<br>↓<br>● *m/z* 188 | N/A | Detects ions that satisfy the specified transition from a fixed precursor *m/z* to a fixed product *m/z* |

FIG. 15

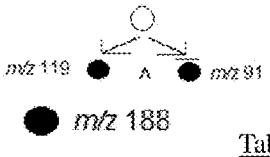

Table 1B: Proposed logical MS/MS operations, terminology, symbolism, and interpretation for new operations

| | | | |
|---|---|---|---|
| TRUE/FALSE | 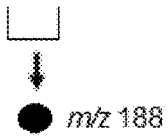  | 1,2,3,4 (TRUE) None (FALSE) | Detects whether any ions in the mass analyzer fragments to a mass-selected product ion; precursor ion *m/z* values are not obtained |
| AND | 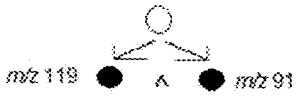  | 4 | Detects precursor ions that fragment to both of two mass-selected product ions |
| BUT NOT NOT…BUT | 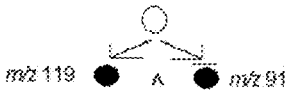  | 2 (BUT NOT) 3 (NOT…BUT) | Detects precursor ions that fragment exclusively to one of two mass-selected product ions but not the other |
| Functional Relationship | 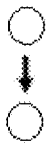 | N/A | Detects precursor ions whose product ions satisfy a given mathematical relationship, e.g., product ions whose *m/z* is half the precursor ion *m/z* |
| Single/Multiple Reaction Monitoring | 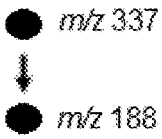  | N/A | Detects ions that satisfy the specified transition from a fixed precursor *m/z* to a fixed product *m/z* |
| TRUE/FALSE | 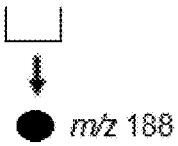  | 1,2,3,4 (TRUE) None (FALSE) | Detects whether any ion in the mass analyzer fragments to a mass-selected product ion; precursor ion *m/z* values are not obtained |
| AND | 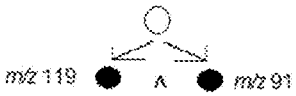  | 3 | Detects precursor ions that fragment to both of two mass-selected product ions |
| BUT NOT NOT…BUT | 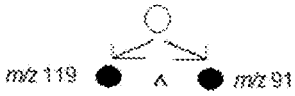  | 2 (BUT NOT) 3 (NOT…BUT) | Detects precursor ions that fragment exclusively to one of two mass-selected product ions but not the other |

FIG. 16

| | | | |
|---|---|---|---|
| LEFT/RIGHT PROJECTION | See 'Precursor Ion Scan' | 2,4 (LEFT)<br>3,4 (RIGHT) | A precursor ion scan |
| XOR (exclusive OR) | m/z 119 V m/z 163 | 2,3 | Detects precursor ions that fragment to either of two mass-selected product ions but not both |
| OR (inclusive) | m/z 119 V m/z 163 | 2,3,4 | Detects precursor ions that fragment to either of two mass-selected product ions or both |
| NEITHER…NOR, i.e. NOR scan | m/z 119 V m/z 91 | 1 | Detects precursor ions that do not fragment to either of two selected product ions |
| IFF (if and only if) | m/z 119 V m/z 91 | 1,4 | Detects precursor ions that fragment to both of two mass-selected products ions or does not fragment solely to one of those two product ions |
| LEFT/RIGHT COMPLEMENTATION, i.e. NOT scan | m/z 188<br>148 Da | 1,3 (LEFT)<br>1,2(RIGHT) | Detects precursor ions that do not fragment to a particular product ion |
| IF<br>IF…THEN | m/z 119 V m/z 91 | 1,2,4 (IF)<br>1,3,4<br>(IF…THEN) | Detects precursor ions that do not fragment to one of two particular product ions and also detects precursor ions that fragment to both product ions |
| NAND | m/z 119 V m/z 91 | 1,2,3 | Detects precursor ions that do not fragment to both of two particular product ions |

FIG. 16 (Continued)

Table 3

| | | | |
|---|---|---|---|
| Beat frequency resonance ejection |  | N/A | Resonant ejection of ions modulated at a particular beat frequency; uses two closely spaced frequencies to form the beat frequency |

LOGICAL OPERATIONS IN MASS SPECTROMETRY

RELATED APPLICATION

The present application is a continuation of U.S. nonprovisional application Ser. No. 17/040,721, filed Sep. 23, 2020, which is a 35 U.S.C. § 371 national phase application of PCT/US19/22721, filed Mar. 18, 2019, which claims the benefit of and priority to U.S. provisional patent application No. 62/647,189, filed Mar. 23, 2018, the content of each which is incorporated by reference herein in its entirety.

FIELD OF THE INVENTION

The invention generally relates to logical operations in mass spectrometry.

BACKGROUND

Current trends in MS continue to move towards more complex and larger systems, emphasizing prior chromatographic separation and high mass resolution. An alternative approach is to use ambient ionization, with miniature instruments, and to quickly perform unit resolution on-site experiments that rely on MS/MS instead of chromatography or high resolution for chemical specificity. Ion traps are particularly appropriate for this purpose, especially when the standard mass-selective instability method of performing a mass scan is replaced by a secular frequency scan. This can be done using function generators to produce a low amplitude dipolar ac signal with swept frequency. More complex experiments can be performed by using two or more such ac signals, giving fields in the x- and y-directions, and operating at fixed or swept frequencies. This approach greatly simplifies ion trap electronics while adding powerful chemically diagnostic capabilities.

SUMMARY

The basic problem being addressed by these new experiments is to access the most efficient methods of selecting data from the 3D data domain that comprises an MS/MS experiment so as to answer particular questions about the chemical structures of compounds in the sample. Or in the case of a pure compound which has been caused to fragment by a method like collision-induced dissociation, to answer the corresponding questions about the structure of the compound.

Complete flexibility in interrogating the data space of MS/MS not only allows the standard scans (product ion scan, precursor ion scan, neutral loss scan and the SRM/MRM experiments) but also any logical operation. In order to extract information with maximum efficiency from the chemical domain (set of molecules with various structures) and present in the MS analytical domain, one should be able to perform any operation that can be specified. Selected operations are described herein.

In certain aspects, the invention provides a system comprising a mass spectrometer comprising one or more ion traps; and a central processing unit (CPU), and storage coupled to the CPU for storing instructions that when executed by the CPU cause the system to apply one or more scan functions to the one or more ion traps in order to accomplish the operations listed in Table 2B.

In certain embodiments, the mass spectrometer comprises only a single ion trap. In other embodiments, the one or more scan functions comprise a broadband sum of sines for precursor ion excitation, followed by single frequencies to determine if selected product ions were formed. In certain embodiments, the precursor ion excitation is performed without determining the precursor ion m/z values. In other embodiments, the one or more scan functions comprise an inverse q scan to excite precursor ions, wherein two frequencies are applied to x electrodes of the one or more ion traps to eject two selected product ions. In certain embodiments, two beat frequencies are used at the product ion ejection frequencies to differentiate the two selected product ions. In other embodiments, the one or more scan functions comprise an inverse Mathieu q scan to excite precursor ions and a broadband waveform to eject all product ions. For example, the broadband waveform may comprise a sum of a plurality of sines with frequency components that vary with time for ejection of the product ions, wherein the broadband waveform further comprises a notch to prevent the ejection of a selected product ion. In preferred embodiments, the broadband waveform comprises a plurality of notches.

In certain embodiments, the one or more scan functions comprise two inverse Mathieu q scans in the y dimension to excite precursor ions and subsequently neutralize product ions as they are formed. In certain embodiments, frequency components of the broadband waveform vary so that the frequencies in the broadband waveform are higher than the inverse Mathieu q scan used for the precursor ion excitation.

In another aspect, the invention provides a system comprising: a mass spectrometer comprising a single ion trap; and a central processing unit (CPU), and storage coupled to the CPU for storing instructions that when executed by the CPU cause the system to apply a plurality of scan functions to the single ion trap in a manner that the single ion trap conducts ion analysis that is conducted in a triple quadrupole mass spectrometer, wherein the plurality of scan functions comprise an inverse Mathieu q scan and at least one additional scan function.

In certain embodiments, the plurality of scan functions applied to the single ion trap cause the single ion trap to conduct a triple resonance precursor scan. In an exemplary embodiments, the triple resonance precursor scan comprises an inverse Mathieu q scan applied to the single ion trap in a y-dimension and an additional frequency applied to the single ion trap in the y-dimension corresponding to a particular $MS^2$ product ion's secular frequency.

In other embodiments, the instructions, wherein executed by the CPU, further the system to apply a beat frequency in the triple resonance precursor scan. The beat frequency may be generated by summing two sine waves with frequencies different by a desired beat frequency with a lower frequency corresponding to a secular frequency of a product ion.

In other embodiments, the plurality of scan functions applied to the single ion trap cause the single ion trap to conduct a neutral loss scan. The neutral loss scan may comprise applying two inverse Mathieu q scans on orthogonal electrodes of the single ion trap to excite precursor ions and then neutralize the precursor ions while triggering a broadband sum of sines to eject all product ions of the excited precursor ions.

In certain embodiments, a third inverse Mathieu q scan is applied to the orthogonal electrodes used for excitation so that particular product ions satisfying a selected neutral loss are removed before they are detected. For example, a plurality of additional inverse Mathieu q scans may be applied to the orthogonal electrodes used for excitation so that at least two particular product ions satisfying selected neutral losses are removed before they are detected.

In other embodiments, the instructions, wherein executed by the CPU, further the system to apply a beat frequency in the neutral loss scan. In certain embodiments, the beat frequency is generated by summing two inverse Mathieu q scans with one of the inverse Mathieu q scans having a constant frequency offset corresponding to a desired beat frequency.

Another aspect of the invention provides a system comprising: a mass spectrometer comprising a single ion trap; and a central processing unit (CPU), and storage coupled to the CPU for storing instructions that when executed by the CPU cause the system to apply a plurality of scan functions to the single ion trap in a manner that the single ion trap conducts ion analysis that is conducted in a triple quadrupole mass spectrometer, while causing the system to also apply a beat frequency to the single ion trap to identify artifact peaks in a generated mass spectrum.

In certain embodiments, the plurality of scan functions applied to the single ion trap cause the single ion trap to conduct a triple resonance precursor scan. For example, the triple resonance precursor scan may comprise an inverse Mathieu q scan applied to the single ion trap in a y-dimension and an additional frequency applied to the single ion trap in the y-dimension corresponding to a particular $MS^2$ product ion's secular frequency.

In other embodiments, the instructions, wherein executed by the CPU, further the system to apply a beat frequency in the triple resonance precursor scan. The beat frequency may be generated by summing two sine waves with frequencies different by a desired beat frequency with a lower frequency corresponding to a secular frequency of a product ion.

In other embodiments, the plurality of scan functions applied to the single ion trap cause the single ion trap to conduct a neutral loss scan. The neutral loss scan may comprise applying two inverse Mathieu q scans on orthogonal electrodes of the single ion trap to excite precursor ions and then neutralize the precursor ions while triggering a broadband sum of sines to eject all product ions of the excited precursor ions.

In certain embodiments, a third inverse Mathieu q scan is applied to the orthogonal electrodes used for excitation so that particular product ions satisfying a selected neutral loss are removed before they are detected. A plurality of additional inverse Mathieu q scans may be applied to the orthogonal electrodes used for excitation so that at least two particular product ions satisfying selected neutral losses are removed before they are detected.

In other embodiments, the instructions, wherein executed by the CPU, further cause the system to apply a beat frequency in the neutral loss scan. The beat frequency may be generated by summing two inverse Mathieu q scans with one of the inverse Mathieu q scans having a constant frequency offset corresponding to a desired beat frequency.

BRIEF DESCRIPTION OF THE DRAWINGS

(FIG. 3A) 'Artifact scan' showing all ions in a mixture of five amphetamines which produce a fragment below the LMCO (m/z 92) and (FIG. 3B) peak FFTs, (FIG. 3C) precursor ion scan of m/z 163 (green peaks) with (red) artifact peaks, (FIG. 3D) peak FFTs from panel c showing no differentiation between red and green peaks, (FIG. 3E) precursor scan of m/z 163 using a beat frequency of 1 kHz for ejection, and (FIG. 3F) peak FFTs showing the difference between boundary ejected ions (m/z 119) and resonantly ejected ions (m/z 180), (FIG. 3G) neutral loss scan of 17 Da using a beat frequency of 1 kHz, and (FIG. 3H) peak FFTs comparing artifact peak at m/z 150 and resonance ejection peak at m/z 180.

FIG. 15 shows Table 1A with proposed logical MS/MS operations, terminology, symbolism, and interpretation for existing operations.

FIG. 16 shows Table 1B with additional proposed logical MS/MS operations, terminology, symbolism, and interpretation for new operations.

DETAILED DESCRIPTION

Figure 1:
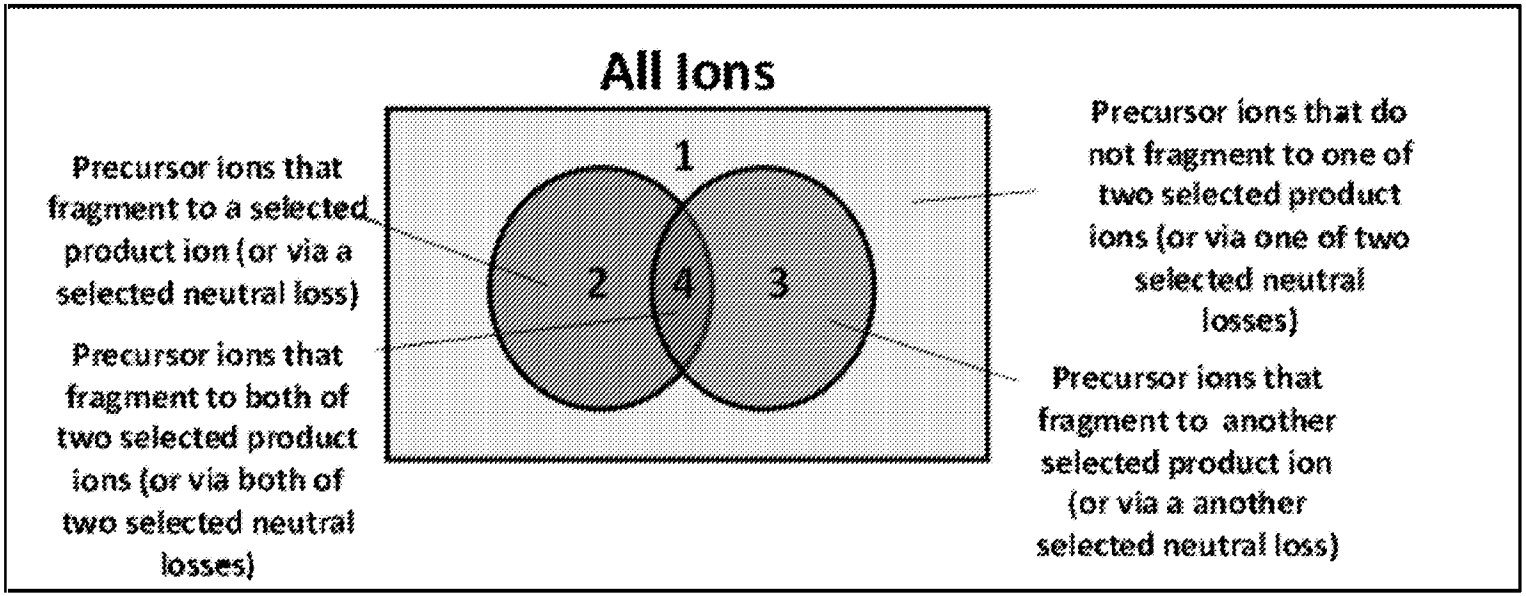
FIG. 1 is a Venn diagram for precursor ions which may fragment via two routes to product ions and corresponding neutrals, e.g. $m_1^+ \rightarrow m_2^+ m_3$

The invention generally relates to logical operations in mass spectrometry. Implementation is done using an ion trap system which operates with constant trapping RF amplitude and in which the three steps of ion isolation (when used), excitation or ejection are performed mass selectively using resonant signals of relatively low amplitude. These orthogonal signals can be applied sequentially or simultaneously, so as to selectively dissociate particular ions and then scan out the products, or to perform the corresponding operations needed to generate constant neutral loss or precursor ion scans in a single analyzer mass spectrometer. For example, the functional group specific neutral loss scan (e.g. loss of 46 or 30 Da implies a nitro group) is performed by fragmenting ions of arbitrary masses while a second signal, in resonance with ions that have lost 46 Da, is applied orthogonally so as to eject these fragment ions. The scan gives all compounds which fragment by loss of 46 Da, viz. it is a neutral loss 46 scan. Other MS/MS experiments like the precursor ion scan are also functional group specific, e.g. formation of the product ion m/z 95 implies phosphonate in the precursor compound. These scans are performed using ac signals of appropriate frequency but in this case the ion ejection frequency is kept fixed (e.g. on m/z 95, in the example above) while the other is scanned.

More complex neutral loss and precursor scans are also possible, for example in the neutral loss case, one in which two ejection frequencies are applied simultaneously (corresponding to loss of 30 Da and 46 Da) and both are orthogonal to the excitation frequency. All three signals must be swept while maintaining constant mass differences. The result is a scan showing all ions which lose a neutral fragment of either 46 or 30 Dalton. The present work describes a set of LOGICAL operations like this one which can be performed using a mass spectrometer operating in the multiple stage $MS^n$ mode. The examples given are for collision induced dissociation (CID) and for $MS^2$, viz. MS/MS experiments, but generalization is straightforward. Several such operations are described but this is not the full set and combinations of operations (some of which are themselves the result of combining basic MS/MS scan types) are of significant interest.

The scans described above require selection/excitation of ions of particular mass/charge while functionally related ions are ejected orthogonally, they also rely on a correlation between fragmentation time (or frequency) and m/z. The ac signals may be applied at constant frequency or the frequency may be scanned depending on the outcome desired. Scans are preferably linear with mass (i.e. m/z should vary linearly with time, in spite of the fact that it varies reciprocally with the Mathieu parameter q). The ability to perform the four basic types of MS/MS experiments is usually associated with a triple quadrupole[19] or other multi-analyzer instrument. It is only recently that precursor and neutral loss scans have been described for single ion trap analyzers. The more complex operations discussed here have not been described before using any type of mass spectrometer. They are here implemented using a single ion trap but other implementations (specifically on triple quadrupole systems) are also readily imagined.

Inverse Mathieu q Scan

An inverse Mathieu q scan is described in U.S. application Ser. No. 15/789,688, the content of which is incorporated by reference herein in its entirety. An inverse Mathieu q scan operates using a method of secular frequency scanning in which mass-to-charge is linear with time. This approach contrasts with linear frequency sweeping that requires a complex nonlinear mass calibration procedure. In the current approach, mass scans are forced to be linear with time by scanning the frequency of a supplementary alternating current (supplementary AC) so that there is an inverse relationship between an ejected ion's Mathieu q parameter and time. Excellent mass spectral linearity is observed using the inverse Mathieu q scan. The rf amplitude is shown to control both the scan range and the scan rate, whereas the AC amplitude and scan rate influence the mass resolution. The scan rate depends linearly on the rf amplitude, a unique feature of this scan. Although changes in either rf or AC amplitude affect the positions of peaks in time, they do not change the mass calibration procedure since this only requires a simple linear fit of m/z vs time. The inverse Mathieu q scan offers a significant increase in mass range and power savings while maintaining access to linearity, paving the way for a mass spectrometer based completely on AC waveforms for ion isolation, ion activation, and ion ejection.

Methods of scanning ions out of quadrupole ion traps for external detection are generally derived from the Mathieu parameters $a_u$ and $q_u$, which describe the stability of ions in quadrupolar fields with dimensions u. For the linear ion trap with quadrupole potentials in x and y, $$q_x=-q_y=8zeV_{0\text{-}p}/\Omega^2(x_0^2+y_0^2)m \tag{1}$$

$$a_x=-a_y=16zeU/\Omega^2(x_0^2+y_0^2)m \tag{2}$$

where z is the integer charge of the ion, e is the elementary charge, U is the DC potential between the rods, $V_{0\text{-}p}$, is the zero-to-peak amplitude of the quadrupolar radiofrequency (rf) trapping potential, Ω is the angular rf frequency, $x_0$ and $y_0$ are the half distances between the rods in those respective dimensions, and m is the mass of the ion. When the dimensions in x and y are identical ($x_0=y_0$), $2r_0^2$ can be substituted for $(x_0^2+y_0^2)$. Solving for m/z, the following is obtained:

$$m/z=4V_{0\text{-}p}/q_x\Omega^2r_0^2 \tag{3}$$

$$m/z=8U/a_x\Omega^2r_0^2 \tag{4}$$

Ion traps are generally operated without DC potentials ($a_u$=U=0) so that all ions occupy the q axis of the Mathieu stability diagram. In the boundary ejection method, first demonstrated in the 3D trap and in the linear ion trap, the rf amplitude is increased so that ions are ejected when their trajectories become unstable at q=0.908, giving a mass spectrum, i.e. a plot of intensity vs m/z since m/z and rf amplitude (i.e. time) are linearly related.

The basis for an inverse Mathieu q scan is derived from the nature of the Mathieu parameter $q_u$ (eq. 3). In order to scan linearly with m/z at constant rf frequency and amplitude, the $q_u$ value of the m/z value being excited should be scanned inversely with time t so that $$q_u=k/(t-j) \tag{5}$$

where k and j are constants determined from the scan parameters. In the mode of operation demonstrated here, the maximum and minimum $q_u$ values ($q_{max}$ and $q_{min}$), which determine the m/z range in the scan, are specified by the user. Because the inverse function does not intersect the q axis (e.g. $q_u$=1/t), the parameter j is used for translation so that the first q value is $q_{max}$. This assumes a scan from high q to low q, which will tend to give better resolution and sensitivity due to the ion frequency shifts mentioned above.

The parameters j and k are calculated from the scan parameters, $$j=q_{min}\Delta t/(q_{min}-q_{max}) \tag{6}$$

$$k=-q_{max}j \tag{7}$$

where Δt is the scan time. Operation in Mathieu q space gives advantages: 1) the waveform frequencies depend only on the rf frequency, not on the rf amplitude or the size or geometry of the device, which implies that the waveform only has to be recalculated if the rf frequency changes (alternatively, the rf amplitude can compensate for any drift in rf frequency), and 2) the mass range and scan rate are controlled by the rf amplitude, mitigating the need for recalculating the waveform in order to change either parameter. It is important to note that we purposely begin with an array of $q_u$ values instead of m/z values for these very reasons.

Once an array of Mathieu $q_u$ values is chosen, they are converted to secular frequencies, which proceeds first through the calculation of the Mathieu $\beta_u$ parameter, $$\beta_u^2 = a_u + \cfrac{q_u^2}{(\beta_u+2)^2 - a_u - \cfrac{q_u^2}{(\beta_u+4)^2 - a_u - \cfrac{q_u^2}{(\beta_u+6)^2 - a_u - \dots}}} + \cfrac{q_u^2}{(\beta_u-2)^2 - a_u - \cfrac{q_u^2}{(\beta_u-4)^2 - a_u - \cfrac{q_u^2}{(\beta_u-6)^2 - a_u - \dots}}} \tag{8}$$

a conversion that can be done by using the algorithm described in Snyder et al. (Rapid Commun. Mass Spectrom. 2016, 30, 1190), the content of which is incorporated by reference herein in its entirety. The final step is to convert Mathieu $\beta_u$ values to secular frequencies (eqns. 9, 10) to give applied AC frequency vs time. Each ion has a set of secular frequencies, $$\omega_{u,n}=|2n+\beta_u|\Omega/2 \quad -\infty<n<\infty \tag{9}$$

where n is an integer, amongst which is the primary resonance frequency, the fundamental secular frequency, $$\omega_{u,0}=\beta_u\Omega/2 \tag{10}$$

This conversion gives an array of frequencies for implementation into a custom waveform calculated in a mathematics suite (e.g. Matlab).

Prior work used a logarithmic sweep of the AC frequency for secular frequency scanning, but, as described here, the relationship between secular frequency and m/z is not logarithmic, resulting in very high mass errors during mass calibration.

In theory, once the Mathieu $q_u$ parameters are converted to secular frequencies, a waveform is obtained. However, this waveform should not be used for secular frequency scanning due to the jagged edges observed throughout the waveform (i.e. phase discontinuities). In the mass spectra, this is observed as periodic spikes in the baseline intensities. Instead, in order to perform a smooth frequency scan, a new parameter Φ is introduced. This corresponds to the phase of the sinusoid at every time step (e.g. the $i^{th}$ phase in the waveform array, where i is an integer from 0 to v*Δt−1). Instead of scanning the frequency of the waveform, the phase of the sinusoid is instead scanned in order to maintain a continuous phase relationship. The relationship between ordinary (i.e. not angular) frequency f and phase Φ is:

$$f(t)=(1/2\pi)(d\Phi/dt)(t) \tag{11}$$

so that $$\Phi(t)=\Phi(0)+2\pi\int_0 f(\tau)d\tau \tag{12}$$

where variable τ has been substituted for time t in order to prevent confusion between the integration limit t and the time variable in the integrand. Thus, the phase of the sine wave at a given time t can be obtained by integrating the function that describes the frequency of the waveform as a function of time, which was previously calculated.

We begin with the phase of the waveform set equal to zero:

$$\Phi(0)=0(t=0) \tag{13}$$

The phase is then incremented according to eqns. 14 and 15, which accumulates (integrates) the frequency of the sinusoid, so that $$\Delta=\omega_{u,0}/v \tag{14}$$

$$\Phi(i+1)=\Phi(i)+\Delta \tag{15}$$

where v is the sampling rate of the waveform generator. Note that $\omega_{u,0}$ is the angular secular frequency ($2*\pi*f_{u,0}$, where $f_{u,0}$ is the ordinary secular frequency in Hz) in units of radians/sec. Thus, sweeping through phase Φ (FIG. 1D) instead of frequency gives a smooth frequency sweep.

Because the relationship between secular frequency and time is approximately an inverse function, the phase will be swept according to the integral of an inverse function, which is a logarithmic function. However, because the relationship between secular frequency and m/z is only approximately an inverse relationship, the phase Φ will deviate from the log function and thus cannot be described analytically (due to eq. 8).

Ion Traps and Mass Spectrometers

Any ion trap known in the art can be used in systems of the invention. Exemplary ion traps include a hyperbolic ion trap (e.g., U.S. Pat. No. 5,644,131, the content of which is incorporated by reference herein in its entirety), a cylindrical ion trap (e.g., Bonner et al., International Journal of Mass Spectrometry and Ion Physics, 24(3):255-269, 1977, the content of which is incorporated by reference herein in its entirety), a linear ion trap (Hagar, Rapid Communications in Mass Spectrometry, 16(6):512-526, 2002, the content of which is incorporated by reference herein in its entirety), and a rectilinear ion trap (U.S. Pat. No. 6,838,666, the content of which is incorporated by reference herein in its entirety).

Any mass spectrometer (e.g., bench-top mass spectrometer of miniature mass spectrometer) may be used in systems of the invention and in certain embodiments the mass spectrometer is a miniature mass spectrometer. An exemplary miniature mass spectrometer is described, for example in Gao et al. (Anal. Chem. 2008, 80, 7198-7205), the content of which is incorporated by reference herein in its entirety. In comparison with the pumping system used for lab-scale instruments with thousands of watts of power, miniature mass spectrometers generally have smaller pumping systems, such as a 18 W pumping system with only a 5 L/min (0.3 $m^3$/hr) diaphragm pump and a 11 L/s turbo pump for the system described in Gao et al. Other exemplary miniature mass spectrometers are described for example in Gao et al. (Anal. Chem., 2008, 80, 7198-7205), Hou et al. (Anal. Chem., 2011, 83, 1857-1861), and Sokol et al. (Int. J. Mass Spectrom., 2011, 306, 187-195), the content of each of which is incorporated herein by reference in its entirety.

Figure 13:
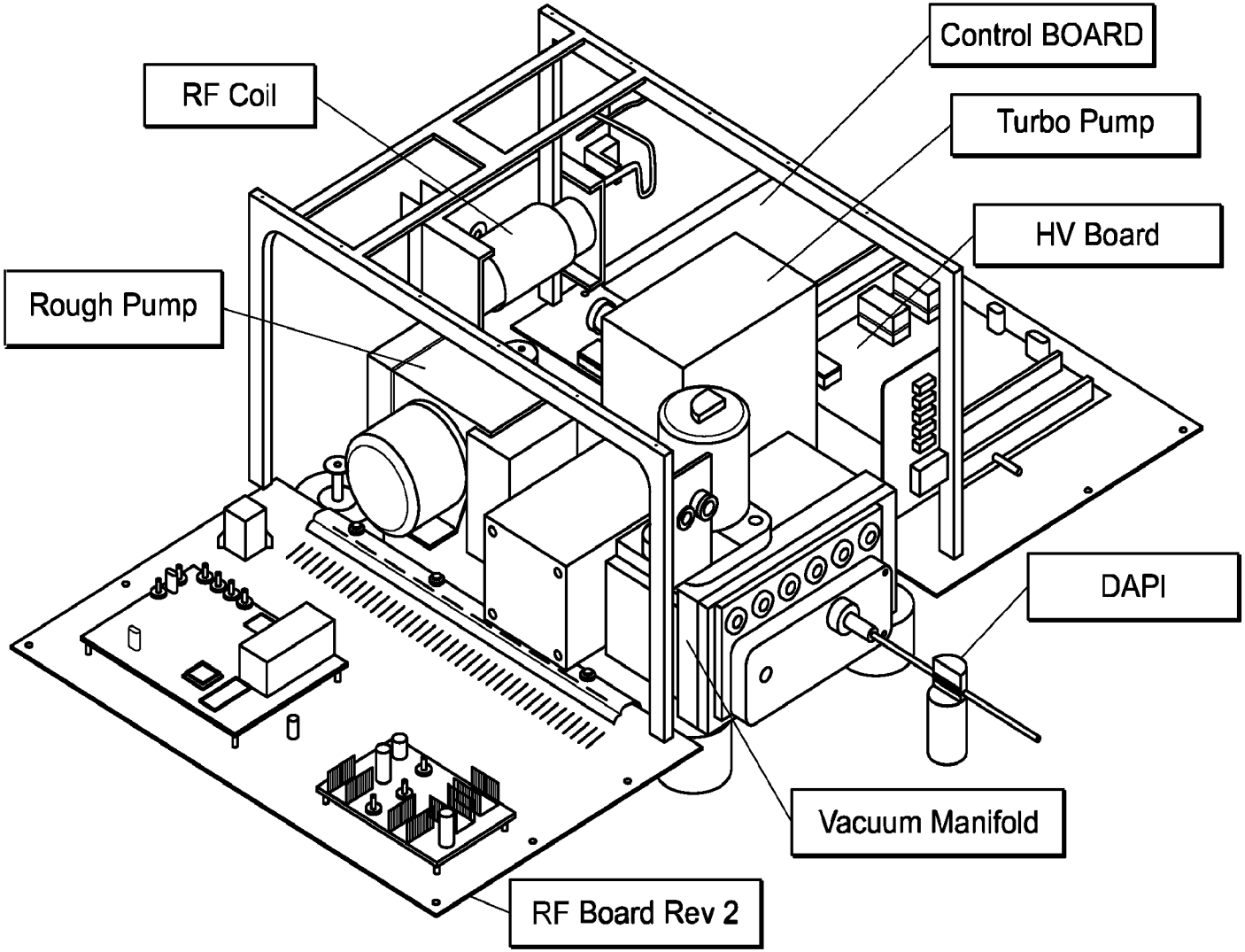
FIG. 13 is a picture illustrating various components and their arrangement in a miniature mass spectrometer.

FIG. 13 is a picture illustrating various components and their arrangement in a miniature mass spectrometer. The control system of the Mini 12 (Linfan Li, Tsung-Chi Chen, Yue Ren, Paul I. Hendricks, R. Graham Cooks and Zheng Ouyang "Miniature Ambient Mass Analysis System" Anal. Chem. 2014, 86 2909-2916, DOI: 10.1021/ac403766c; and 860. Paul I. Hendricks, Jon K. Dalgleish, Jacob T. Shelley, Matthew A. Kirleis, Matthew T. McNicholas, Linfan Li, Tsung-Chi Chen, Chien-Hsun Chen, Jason S. Duncan, Frank Boudreau, Robert J. Noll, John P. Denton, Timothy A. Roach, Zheng Ouyang, and R. Graham Cooks "Autonomous in-situ analysis and real-time chemical detection using a backpack miniature mass spectrometer: concept, instrumentation development, and performance" Anal. Chem., 2014, 86 2900-2908 DOI: 10.1021/ac403765x, the content of each of which is incorporated by reference herein in its entirety), and the vacuum system of the Mini 10 (Liang Gao, Qingyu Song, Garth E. Patterson, R. Graham Cooks and Zheng Ouyang, "Handheld Rectilinear Ion Trap Mass Spectrometer", Anal. Chem., 78 (2006) 5994-6002 DOI: 10.1021/ac061144k, the content of which is incorporated by reference herein in its entirety) may be combined to produce the miniature mass spectrometer shown in FIG. 7. It may have a size similar to that of a shoebox (H20×W25 cm×D35 cm). In certain embodiments, the miniature mass spectrometer uses a dual LIT configuration, which is described for example in Owen et al. (U.S. patent application Ser. No. 14/345,672), and Ouyang et al. (U.S. patent application Ser. No. 61/865,377), the content of each of which is incorporated by reference herein in its entirety.

Ionization Sources

In certain embodiments, the systems of the invention include an ionizing source, which can be any type of ionizing source known in the art. Exemplary mass spectrometry techniques that utilize ionization sources at atmospheric pressure for mass spectrometry include paper spray ionization (ionization using wetted porous material, Ouyang et al., U.S. patent application publication number 2012/0119079), electrospray ionization (ESI; Fenn et al., Science, 1989, 246, 64-71; and Yamashita et al., J. Phys. Chem., 1984, 88, 4451-4459); atmospheric pressure ionization (APCI; Carroll et al., Anal. Chem. 1975, 47, 2369-2373); and atmospheric pressure matrix assisted laser desorption ionization (AP-MALDI; Laiko et al. Anal. Chem., 2000, 72, 652-657; and Tanaka et al. Rapid Commun. Mass Spectrom., 1988, 2, 151-153). The content of each of these references is incorporated by reference herein in its entirety.

Exemplary mass spectrometry techniques that utilize direct ambient ionization/sampling methods include desorption electrospray ionization (DESI; Takats et al., Science, 2004, 306, 471-473, and U.S. Pat. No. 7,335,897); direct analysis in real time (DART; Cody et al., Anal. Chem., 2005, 77, 2297-2302); atmospheric pressure dielectric barrier discharge Ionization (DBDI; Kogelschatz, Plasma Chemistry and Plasma Processing, 2003, 23, 1-46, and PCT international publication number WO 2009/102766), and electrospray-assisted laser desorption/ionization (ELDI; Shiea et al., J. Rapid Communications in Mass Spectrometry, 2005, 19, 3701-3704). The content of each of these references in incorporated by reference herein its entirety.

System Architecture

Figure 14:
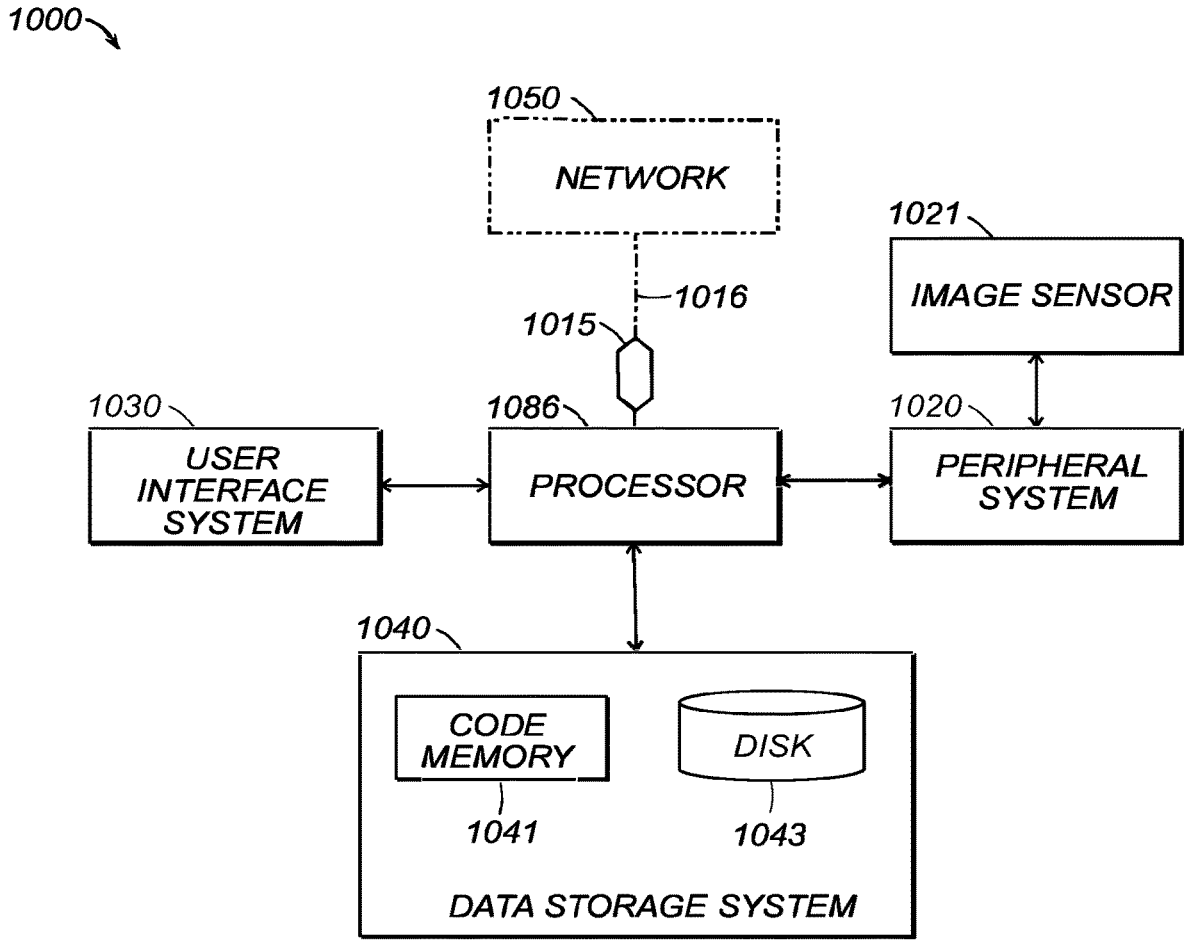
FIG. 14 shows a high-level diagram of the components of an exemplary data-processing system for analyzing data and performing other analyses described herein, and related components.

FIG. 14 is a high-level diagram showing the components of an exemplary data-processing system 1000 for analyzing data and performing other analyses described herein, and related components. The system includes a processor 1086, a peripheral system 1020, a user interface system 1030, and a data storage system 1040. The peripheral system 1020, the user interface system 1030 and the data storage system 1040 are communicatively connected to the processor 1086. Processor 1086 can be communicatively connected to network 1050 (shown in phantom), e.g., the Internet or a leased line, as discussed below. The data described above may be obtained using detector 1021 and/or displayed using display units (included in user interface system 1030) which can each include one or more of systems 1086, 1020, 1030, 1040, and can each connect to one or more network(s) 1050. Processor 1086, and other processing devices described herein, can each include one or more microprocessors, microcontrollers, field-programmable gate arrays (FPGAs), application-specific integrated circuits (ASICs), programmable logic devices (PLDs), programmable logic arrays (PLAs), programmable array logic devices (PALs), or digital signal processors (DSPs).

Processor 1086 which in one embodiment may be capable of real-time calculations (and in an alternative embodiment configured to perform calculations on a non-real-time basis and store the results of calculations for use later) can implement processes of various aspects described herein. Processor 1086 can be or include one or more device(s) for automatically operating on data, e.g., a central processing unit (CPU), microcontroller (MCU), desktop computer, laptop computer, mainframe computer, personal digital assistant, digital camera, cellular phone, smartphone, or any other device for processing data, managing data, or handling data, whether implemented with electrical, magnetic, optical, biological components, or otherwise. The phrase "communicatively connected" includes any type of connection, wired or wireless, for communicating data between devices or processors. These devices or processors can be located in physical proximity or not. For example, subsystems such as peripheral system 1020, user interface system 1030, and data storage system 1040 are shown separately from the data processing system 1086 but can be stored completely or partially within the data processing system 1086.

The peripheral system 1020 can include one or more devices configured to provide digital content records to the processor 1086. For example, the peripheral system 1020 can include digital still cameras, digital video cameras, cellular phones, or other data processors. The processor 1086, upon receipt of digital content records from a device in the peripheral system 1020, can store such digital content records in the data storage system 1040.

The user interface system 1030 can include a mouse, a keyboard, another computer (e.g., a tablet) connected, e.g., via a network or a null-modem cable, or any device or combination of devices from which data is input to the processor 1086. The user interface system 1030 also can include a display device, a processor-accessible memory, or any device or combination of devices to which data is output by the processor 1086. The user interface system 1030 and the data storage system 1040 can share a processor-accessible memory.

In various aspects, processor 1086 includes or is connected to communication interface 1015 that is coupled via network link 1016 (shown in phantom) to network 1050. For example, communication interface 1015 can include an integrated services digital network (ISDN) terminal adapter or a modem to communicate data via a telephone line; a network interface to communicate data via a local-area network (LAN), e.g., an Ethernet LAN, or wide-area network (WAN); or a radio to communicate data via a wireless link, e.g., WiFi or GSM. Communication interface 1015 sends and receives electrical, electromagnetic or optical signals that carry digital or analog data streams representing various types of information across network link 1016 to network 1050. Network link 1016 can be connected to network 1050 via a switch, gateway, hub, router, or other networking device.

Processor 1086 can send messages and receive data, including program code, through network 1050, network link 1016 and communication interface 1015. For example, a server can store requested code for an application program (e.g., a JAVA applet) on a tangible non-volatile computer-readable storage medium to which it is connected. The server can retrieve the code from the medium and transmit it through network 1050 to communication interface 1015. The received code can be executed by processor 1086 as it is received, or stored in data storage system 1040 for later execution.

Data storage system 1040 can include or be communicatively connected with one or more processor-accessible memories configured to store information. The memories can be, e.g., within a chassis or as parts of a distributed system. The phrase "processor-accessible memory" is intended to include any data storage device to or from which processor 1086 can transfer data (using appropriate components of peripheral system 1020), whether volatile or non-volatile; removable or fixed; electronic, magnetic, optical, chemical, mechanical, or otherwise. Exemplary processor-accessible memories include but are not limited to: registers, floppy disks, hard disks, tapes, bar codes, Compact Discs, DVDs, read-only memories (ROM), Universal Serial Bus (USB) interface memory device, erasable programmable read-only memories (EPROM, EEPROM, or Flash), remotely accessible hard drives, and random-access memories (RAMs). One of the processor-accessible memories in the data storage system 1040 can be a tangible non-transitory computer-readable storage medium, i.e., a non-transitory device or article of manufacture that participates in storing instructions that can be provided to processor 1086 for execution.

In an example, data storage system 1040 includes code memory 1041, e.g., a RAM, and disk 1043, e.g., a tangible computer-readable rotational storage device such as a hard drive. Computer program instructions are read into code memory 1041 from disk 1043. Processor 1086 then executes one or more sequences of the computer program instructions loaded into code memory 1041, as a result performing process steps described herein. In this way, processor 1086 carries out a computer implemented process. For example, steps of methods described herein, blocks of the flowchart illustrations or block diagrams herein, and combinations of those, can be implemented by computer program instructions. Code memory 1041 can also store data, or can store only code.

Various aspects described herein may be embodied as systems or methods. Accordingly, various aspects herein may take the form of an entirely hardware aspect, an entirely software aspect (including firmware, resident software, micro-code, etc.), or an aspect combining software and hardware aspects. These aspects can all generally be referred to herein as a "service," "circuit," "circuitry," "module," or "system."

Furthermore, various aspects herein may be embodied as computer program products including computer readable program code stored on a tangible non-transitory computer readable medium. Such a medium can be manufactured as is conventional for such articles, e.g., by pressing a CD-ROM. The program code includes computer program instructions that can be loaded into processor 1086 (and possibly also other processors) to cause functions, acts, or operational steps of various aspects herein to be performed by the processor 1086 (or other processor). Computer program code for carrying out operations for various aspects described herein may be written in any combination of one or more programming language(s), and can be loaded from disk 1043 into code memory 1041 for execution. The program code may execute, e.g., entirely on processor 1086, partly on processor 1086 and partly on a remote computer connected to network 1050, or entirely on the remote computer.

Discontinuous Atmospheric Pressure Interface (DAPI)

In certain embodiments, the systems of the invention can be operated with a Discontinuous Atmospheric Pressure Interface (DAPI). A DAPI is particularly useful when coupled to a miniature mass spectrometer, but can also be used with a standard bench-top mass spectrometer. Discontinuous atmospheric interfaces are described in Ouyang et al. (U.S. Pat. No. 8,304,718 and PCT application number PCT/US2008/065245), the content of each of which is incorporated by reference herein in its entirety.

Samples

A wide range of heterogeneous samples can be analyzed, such as biological samples, environmental samples (including, e.g., industrial samples and agricultural samples), and food/beverage product samples, etc.

Exemplary environmental samples include, but are not limited to, groundwater, surface water, saturated soil water, unsaturated soil water; industrialized processes such as waste water, cooling water; chemicals used in a process, chemical reactions in an industrial processes, and other systems that would involve leachate from waste sites; waste and water injection processes; liquids in or leak detection around storage tanks; discharge water from industrial facilities, water treatment plants or facilities; drainage and leachates from agricultural lands, drainage from urban land uses such as surface, subsurface, and sewer systems; waters from waste treatment technologies; and drainage from mineral extraction or other processes that extract natural resources such as oil production and in situ energy production.

Additionally exemplary environmental samples include, but certainly are not limited to, agricultural samples such as crop samples, such as grain and forage products, such as soybeans, wheat, and corn. Often, data on the constituents of the products, such as moisture, protein, oil, starch, amino acids, extractable starch, density, test weight, digestibility, cell wall content, and any other constituents or properties that are of commercial value is desired.

Exemplary biological samples include a human tissue or bodily fluid and may be collected in any clinically acceptable manner. A tissue is a mass of connected cells and/or extracellular matrix material, e.g. skin tissue, hair, nails, nasal passage tissue, CNS tissue, neural tissue, eye tissue, liver tissue, kidney tissue, placental tissue, mammary gland tissue, placental tissue, mammary gland tissue, gastrointestinal tissue, musculoskeletal tissue, genitourinary tissue, bone marrow, and the like, derived from, for example, a human or other mammal and includes the connecting material and the liquid material in association with the cells and/or tissues. A body fluid is a liquid material derived from, for example, a human or other mammal. Such body fluids include, but are not limited to, mucous, blood, plasma, serum, serum derivatives, bile, blood, maternal blood, phlegm, saliva, sputum, sweat, amniotic fluid, menstrual fluid, mammary fluid, peritoneal fluid, urine, semen, and cerebrospinal fluid (CSF), such as lumbar or ventricular CSF. A sample may also be a fine needle aspirate or biopsied tissue. A sample also may be media containing cells or biological material. A sample may also be a blood clot, for example, a blood clot that has been obtained from whole blood after the serum has been removed.

In one embodiment, the biological sample can be a blood sample, from which plasma or serum can be extracted. The blood can be obtained by standard phlebotomy procedures and then separated. Typical separation methods for preparing a plasma sample include centrifugation of the blood sample. For example, immediately following blood draw, protease inhibitors and/or anticoagulants can be added to the blood sample. The tube is then cooled and centrifuged, and can subsequently be placed on ice. The resultant sample is separated into the following components: a clear solution of blood plasma in the upper phase; the buffy coat, which is a thin layer of leukocytes mixed with platelets; and erythrocytes (red blood cells). Typically, 8.5 mL of whole blood will yield about 2.5-3.0 mL of plasma.

Blood serum is prepared in a very similar fashion. Venous blood is collected, followed by mixing of protease inhibitors and coagulant with the blood by inversion. The blood is allowed to clot by standing tubes vertically at room temperature. The blood is then centrifuged, wherein the resultant supernatant is the designated serum. The serum sample should subsequently be placed on ice.

Prior to analyzing a sample, the sample may be purified, for example, using filtration or centrifugation. These techniques can be used, for example, to remove particulates and chemical interference. Various filtration media for removal of particles includes filer paper, such as cellulose and membrane filters, such as regenerated cellulose, cellulose acetate, nylon, PTFE, polypropylene, polyester, polyethersulfone, polycarbonate, and polyvinylpyrolidone. Various filtration media for removal of particulates and matrix interferences includes functionalized membranes, such as ion exchange membranes and affinity membranes; SPE cartridges such as silica- and polymer-based cartridges; and SPE (solid phase extraction) disks, such as PTFE- and fiberglass-based. Some of these filters can be provided in a disk format for loosely placing in filter holdings/housings, others are provided within a disposable tip that can be placed on, for example, standard blood collection tubes, and still others are provided in the form of an array with wells for receiving pipetted samples. Another type of filter includes spin filters. Spin filters consist of polypropylene centrifuge tubes with cellulose acetate filter membranes and are used in conjunction with centrifugation to remove particulates from samples, such as serum and plasma samples, typically diluted in aqueous buffers.

Filtration is affected in part, by porosity values, such that larger porosities filter out only the larger particulates and smaller porosities filtering out both smaller and larger porosities. Typical porosity values for sample filtration are the 0.20 and 0.45 μm porosities. Samples containing colloidal material or a large amount of fine particulates, considerable pressure may be required to force the liquid sample through the filter. Accordingly, for samples such as soil extracts or wastewater, a pre-filter or depth filter bed (e.g. "2-in-1" filter) can be used and which is placed on top of the membrane to prevent plugging with samples containing these types of particulates.

In some cases, centrifugation without filters can be used to remove particulates, as is often done with urine samples. For example, the samples are centrifuged. The resultant supernatant is then removed and frozen.

After a sample has been obtained and purified, the sample can be analyzed to determine the concentration of one or more target analytes, such as elements within a blood plasma sample. With respect to the analysis of a blood plasma sample, there are many elements present in the plasma, such as proteins (e.g., Albumin), ions and metals (e.g., iron), vitamins, hormones, and other elements (e.g., bilirubin and uric acid). Any of these elements may be detected using methods of the invention. More particularly, methods of the invention can be used to detect molecules in a biological sample that are indicative of a disease state.

EXAMPLES

The ability to operate the ion trap MS using sets of frequencies connected by logical operations is highly promising in terms of applications to in-field complex sample analysis. The figures and discussion which follow give examples of logical scans, but it is noted that this is not a comprehensive list. Furthermore, combinations of several logical scans are imaginable and might prove valuable. Scans which recognize a chemical tag or characteristic feature and then characterize it would fall into this class.

Chemicals: Amphetamine (m/z 136), methamphetamine (m/z 150), 3,4-methylenedioxyamphetamine (m/z 180), 3,4-methylenedioxymethamphetamine (m/z 194), 3,4-methylenedioxyethylamphetamine (m/z 208), fentanyl (m/z 337), acetyl fentanyl (m/z 323), butyryl fentanyl (m/z 351), furanyl fentanyl (m/z 375), cis-3-methylfentanyl hydrochloride (m/z 351), acryl fentanyl hydrochloride (m/z 335), carfentanil oxalate (m/z 395), norcarfentanil (m/z 291), remifentanil hydrochloride (m/z 377), sufentanil citrate (m/z 387), and alfentanil hydrochloride (m/z 417) were purchased from Cerilliant (Round Rock, Tex., U.S.A.). Chemical warfare agent simulants were purchased from Sigma Aldrich. Samples were diluted to concentrations between 1 and 10 μg/mL in 50:50 methanol/water with 0.1% formic acid added to improve ionization. All analytes were detected in the protonated form in the positive ion mode. HPLC grade methanol was purchased from Fisher Scientific (Hampton, N.H., U.S.A.). Fragmentation data for all compounds used in this study is shown in Table 1 (FIGS. 15 and 16) for reference.

Ionization: Most analytes were ionized in the positive ion mode by nanoelectrospray ionization. Chemical warfare agent simulants were ionized in negative ion mode. Briefly, 1.5 kV was applied to a nanospray electrode holder (glass size 1.5 mm), which was purchased from Warner Instruments (Hamden, Conn., U.S.A.) and fitted with 0.127 mm diameter silver wire, part number 00303 (Alfa Aesar, Ward Hill, Mass.), as the electrode. Borosilicate glass capillaries (1.5 mm O.D., 0.86 mm I.D.) from Sutter Instrument Co. (Novato, Calif., U.S.A.) were pulled to 2 μm tip diameters using a Flaming/Brown micropipette puller (model P-97, Sutter Instrument Co.).

Instrumentation: A Finnigan LTQ linear ion trap (San Jose, Calif., USA) was used for all experiments. The internal dimensions of the three-section trap are as follows: $x_0$=4.75 mm, $y_0$=4 mm, axial sections of length 12, 37, and 12 mm. The rf frequency was tuned to 1.166 MHz and the rf amplitude was held constant throughout ionization, cooling, and mass scan periods by substituting the rf modulation signal usually supplied by the instrument with a ~600 ms DC pulse (90% duty cycle) of amplitude between 160 mV and 280 mV (corresponding to approximate low-mass cutoffs of 76 Th and 159 Th, respectively, scaling linearly with the DC pulse amplitude) from an external function generator. Nitrogen was used as bath gas at an ion gauge reading of $1.3\times10^{-5}$ torr.

The LTQ rf coil was modified as described previously[14,16,17] to allow low voltage ac signals from external function generators to be coupled onto the main rf on the x and y rods. The rf is applied in a quadrupolar fashion while each pair of ac signals is dipolar. Low voltage ac waveforms were applied by two Keysight 33612A (Chicago, Ill., U.S.A.) function generators with 64 megasample memory upgrades for each channel. All waveforms (aside from single frequencies) were calculated in Matlab (Mathworks, Natick, Mass.) and imported to the function generators as .csv column vectors. For ion excitation, the ac amplitude was between 100 $mV_{pp}$ and 200 $mV_{pp}$ for single frequencies and ~2 $V_{pp}$ for broadband (multi-frequency) waveforms. For ion ejection or artifact rejection, the ac amplitude was 500 $mV_{pp}$ for single frequency waveforms and 3.8 $V_{pp}$ for broadband waveforms. Ion excitation waveforms and artifact rejection waveforms were always applied to the y electrodes to reduce the contribution of artifact peaks and also neutralize certain precursor and product ion species on the y rods, while product ion ejection waveforms were always applied to the x electrodes for ejection of mass-selected ions to the detectors. Function generators were triggered during the ionization step using the LTQ 'Diagnostics' menu, and their outputs were delayed so they applied waveforms during the mass scan segment, during which the data acquisition rate was approximately 28.7 kHz.

Waveform Calculation: Inverse Mathieu q scans were calculated via a program in Matlab as described previously (Snyder, D. T.; Pulliam, C. J.; Cooks, R. G. Rapid Commun. Mass Spectrom. 2016, 30, 2369-2378, the content of which is incorporated by reference herein in its entirety). The inverse Mathieu q scan is a nonlinear ac frequency sweep with approximately linear mass scale. The starting frequency always corresponded to q=0.908, the end frequency corresponded to q=0.15, and the scan time was set at 600 ms. Broadband ac waveforms were also calculated in Matlab and had general characteristics of a 5 MHz sampling rate, 1 kHz frequency spacing, and phases distributed quadratically with frequency in order to obtain a flat amplitude profile with respect to time and also to ensure that all included frequencies are represented at each point in the waveform. Without phase overmodulation, the broadband waveform would, in part, act as a frequency sweep, with only certain frequencies present at any given point in the waveform. Broadband waveforms contained zero, one, or two notches, with each notch being 10 kHz wide. For broadband waveforms whose frequency components did not vary with time (e.g. in TRUE/FALSE scans), the waveform spanned 300 kHz (q=0.654) to 50 kHz (q=0.12). In cases where the inverse Mathieu q scan was used for ion excitation, the frequencies present in the broadband ejection waveform varied with time so that at any given point in the broadband waveform the lower bound of the frequencies included in the waveform was 10 kHz higher than the corresponding frequency being applied the inverse Mathieu q scan at the same point in time. This ensures that precursor ions are not ejected by the broadband waveform before they are excited by the inverse Mathieu q scan.

Example 1: Selected Operations

FIG. 1 illustrates logical MS/MS operations using a Venn diagram. The outer box represents all precursor ions in the mass analyzer. The two circles represent two selected product ions (or neutral losses), and hence all ions in the mass analyzer either 1) do not fragment to either product ion (region 1), 2) fragment to the first selected product ion but not the second (region 2), 3) fragment to the second selected product ion but not the first (region 3), or 4) fragment to both selected product ions (region 4). A logical MS/MS operation is a single scan which therefore accurately places ions into one of these four regions. (Strictly speaking, a simple precursor ion scan or neutral loss scan by itself is a logical operation; in this case there is only one circle in the Venn diagram because only one connection between precursor ions and product ions (or neutral losses) is made.) Logical operations can be extended to cases where there are more than two circles (i.e. more than two product ions or neutral losses of interest), but here we limit ourselves to the two-circle instances.

For the case of two selected product ions (or neutral losses), there are sixteen possible logical operations: 1)

FALSE, 2) AND, 3) BUT NOT, 4) LEFT PROJECTION, 5) NOT . . . BUT, 6) RIGHT PROJECTION, 7) XOR (exclusive OR), 8) OR (inclusive), 9) NEITHER . . . NOR, 10) IFF (if and only if), 11) RIGHT COMPLEMENTATION, 12) IF, 13) LEFT COMPLEMENTATION, 14) IF . . . THEN, 15) NAND, and 16) TRUE.

Figure 2A:
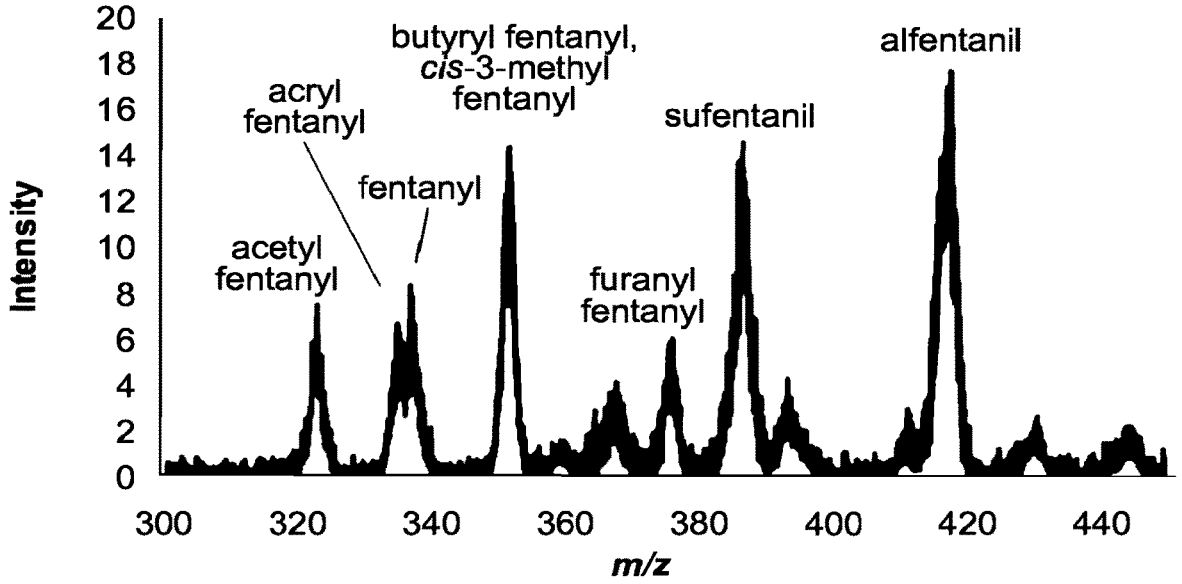
FIG. 2A shows a full scan mass spectrum of eight fentanyl analogs.
Figure 2B:
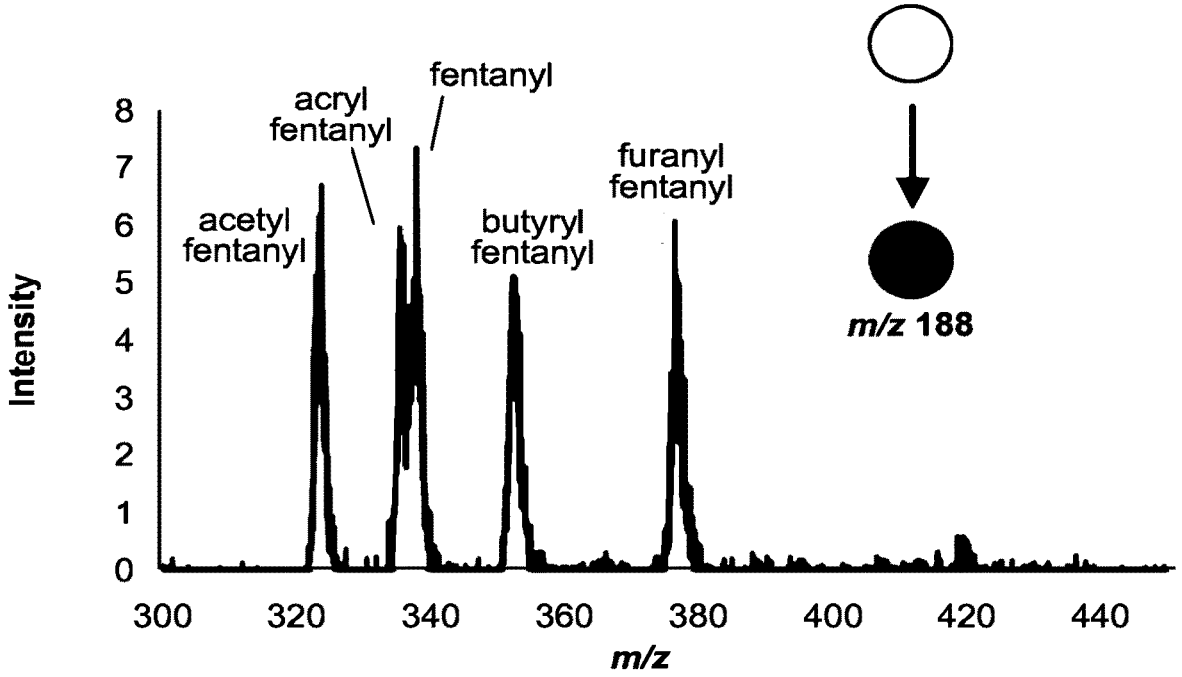
FIG. 2B shows a precursor scan showing all precursor ions that fragment to m/z 188 and so are concluded to have the N-β-phenylethyl-piperidyl functional group.
Figure 2C:
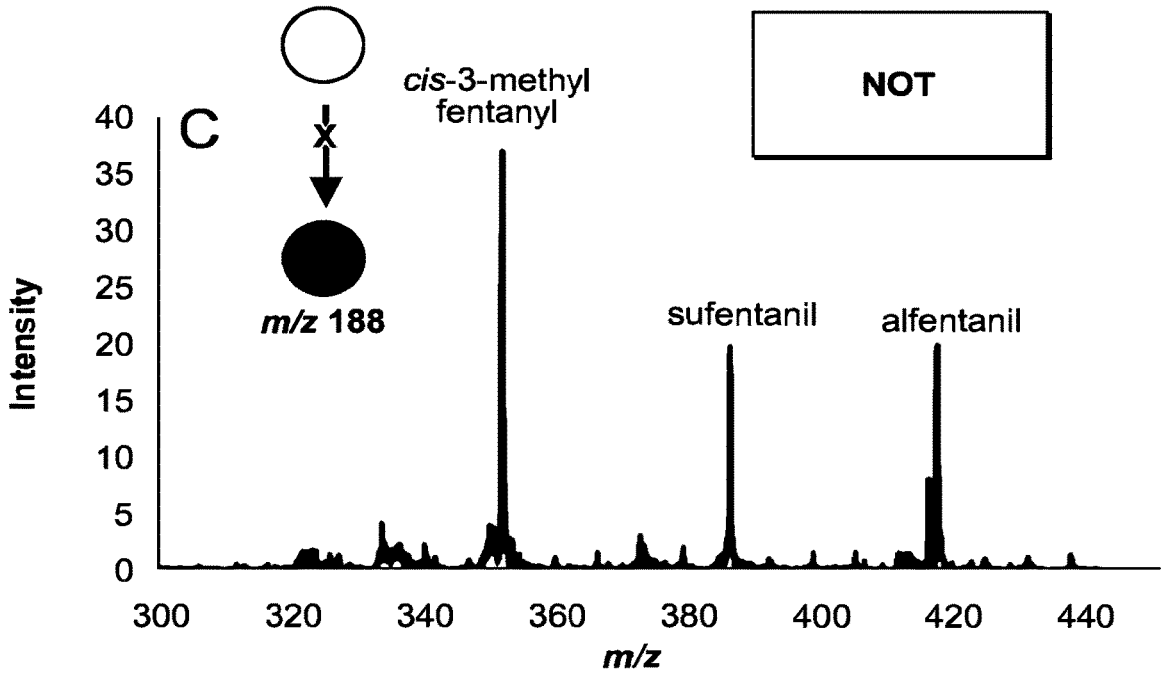
FIG. 2C shows a logical NOT scan for product ion m/z 188, which detects all precursor ions that do not have this fragment ion and hence do not belong to this group.

Selected operations answer questions like (i) which of the eight fentanyls (FIG. 2A) has the N-β-phenylethyl-piperidyl functional group? (Answered by a simple precursor scan of m/z 188, FIG. 2B) and (ii) which do not? Answered using a NOT scan (FIG. 2C), a new logical operation. Note that the two operations are logical complements and their addition should (and does) reconstitute the original data set. Note that the NOT scan operationally is the result of exciting all trapped ions with a dipolar frequency sweep applied in the y-direction and then recording the resulting signal using an broadband ac scan in the x-direction to eject and detect all products (using a multi-frequency broadband waveform) except that this signal is notched (zero amplitude) at the frequency corresponding to m/z 188.

TABLE 2A

Implementation of LOGICAL MS/MS on linear quadrupole ion traps and triple quadrupoles for existing scan functions

| Operation | Ion Trap Implementation* | Tripe Quadrupole Implementation |
|---|---|---|
| Product Ion | Resonance excitation followed by a full mass scan | Fix Q1, fragment q2, scan Q3 |
| Precursor Ion | Resonance excitation of precursors with simultaneous ejection of selected product ion with a fixed ac frequency | Scan Q1, fragment q2, fix Q3 |
| Neutral Loss | Three simultaneous frequency sweeps with constant mass offset | Scan Q1 and Q3 with fixed mass offset, fragment q2 |
| Functional Relationship | Three simultaneous frequency scans with variable mass offset | Scan Q1 and Q3 with certain mathematical relationship, fragment q2 |

TABLE 2B

Implementation of LOGICAL MS/MS on linear quadrupole ion traps and triple quadrupoles for new scan functions

| Operation | Ion Trap Implementation* | Tripe Quadrupole Implementation |
|---|---|---|
| TRUE/FALSE | (Pre) Broadband excitation of precursors followed by ejection of m/z via single frequency; (NL) none unless precursor ion m/z values are known beforehand | Pass all ions through Q1, fragment in fixed q2, fix Q3 |
| AND | Double precursor ion scan or double neutral loss scan using two different (nonharmonic) beat frequencies; peaks must correspond to both beats | Scan Q1, fragment in q2, quickly alternate Q3 between the two fixed masses (or neutral loss products); peaks must correspond to both product ion masses |
| NOT. . . BUT, BUT NOT | Double precursor ion or neutral loss scan using two different (nonharmonic) beat frequencies; peaks must correspond to one beat but not the other | Scan Q1, fragment in q2, quickly alternate Q3 between the two fixed masses (or neutral loss products); peaks must correspond to one of the selected product ions but not the other |
| LEFT/RIGHT PROJECTION, i.e. a precursor ion scan | See 'Precursor Ion' above | See 'Precursor Ion' above |
| XOR (exclusive OR) | Double precursor ion or double neutral loss scan using two different (nonharmonic) beat frequencies; peaks must correspond to either beat but not both | Scan Q1, fragment in q2, quickly alternate Q3 between the two fixed masses (or neutral loss products); peaks must correspond to one of the selected product ions but not both |
| Or (INCLUSIVE) | Double precursor ion or neutral loss scan; no beat frequency required | Scan Q1, fragment in q2, quickly alternate Q3 between the two fixed masses (or neutral loss products); peaks must correspond to one of the selected product ions or both product ions |
| NEITHER. . . NOR (i.e. NOR scan) | (Pre) Single frequency sweep for precursor ion excitation with doubly notched broadband waveform for product ion ejection; (NL) Single frequency sweep for precursor ion excitation; broadband waveform for product ion ejection; two additional frequency sweeps for neutralization of neutral loss product ions on y rods | Scan Q1, fragment in q2, operate Q3 in rf-only mode with two dipolar ac frequencies used to reject both mass-selected product ions; will have low performance for instruments with short rods or low rf frequencies |

TABLE 2B-continued

| Implementation of LOGICAL MS/MS on linear quadrupole ion traps and triple quadrupoles for new scan functions | | |
|---|---|---|
| Operation | Ion Trap Implementation* | Tripe Quadrupole Implementation |
| RIGHT/LEFT COMPLEMENTATION (i.e. NOT scan | (Pre) Single frequency sweep for precursor ion excitation with singly notched broadband waveform for product ion ejection; (NL) no notch in broadband waveform; reject NL products into y electrodes with frequency sweep | Scan Q1, fragment in q2, operate Q3 in rf-only mode with one dipolar ac frequency used to reject a mass-selected product ion; will have low performance for instruments with short rods or low rf frequencies |

Figure 17:
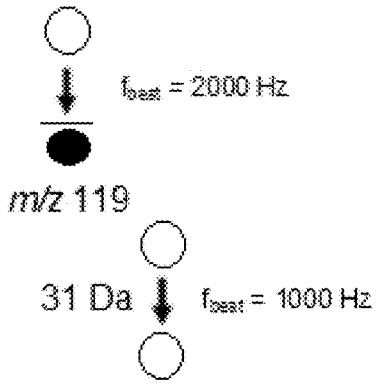
FIG. 17 shows Table 3 illustrating the use of beat frequencies to discriminate between resonant ejection and ejection of ions below the low mass cutoff.

Example 2: Use of Beat Frequencies to Discriminate Between Resonant Ejection and Ejection of Ions Below the Low Mass Cutoff A peculiarity of ion trap mass spectrometers is that ions can be ejected from the trap and seen as detector signals if they fall in a region of instability below the low mass cutoff (LMCO). Such signals are readily distinguished from genuine MS/MS signals from resonance ejection in a single scan if a second ac signal is applied, either to the precursor or more usually to the product ion so as to set up a low frequency beat signal in the recorded data (Table 3 shown in FIG. 17).

The data shown in FIG. 3 demonstrate that beat frequencies in a signal due to resonant ejection can be used to discriminate between artifact signals due to ions below the LMCO and genuine resonance ejection signals. Only resonantly ejected (or excited) ions whose secular frequencies are close to the two signals applied to generate the beat frequency have their peak shapes modulated by that beat frequency. Beat frequencies are discussed further in other Examples herein.

Example 3: Neutral Loss and Precursor Scans

Figure 4A:
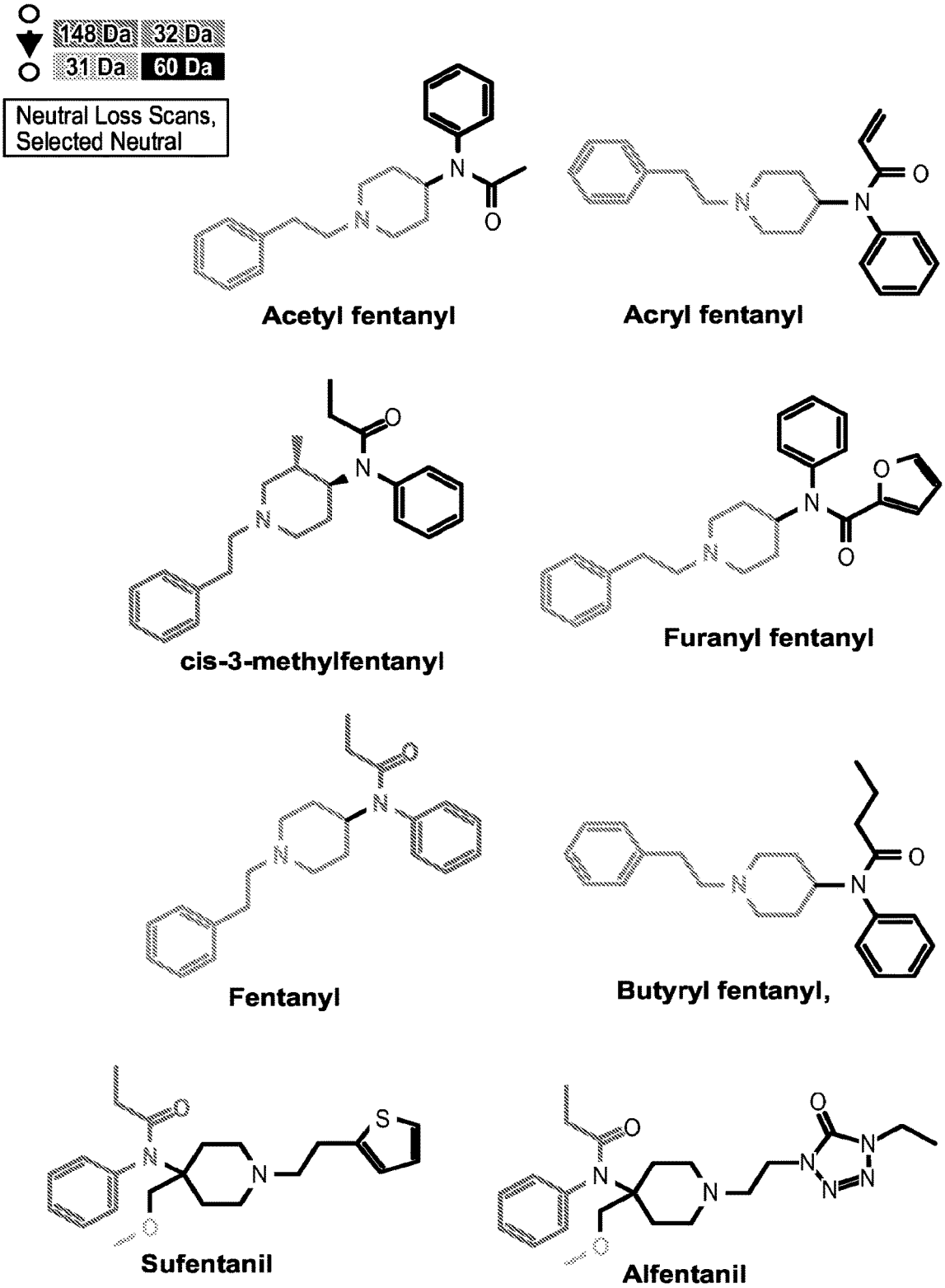
FIGS. 4A-B show structures of some fentanyl opioids and characteristic neutral losses and precursors. Color coded for the particular functional groups.
Figure 4B:
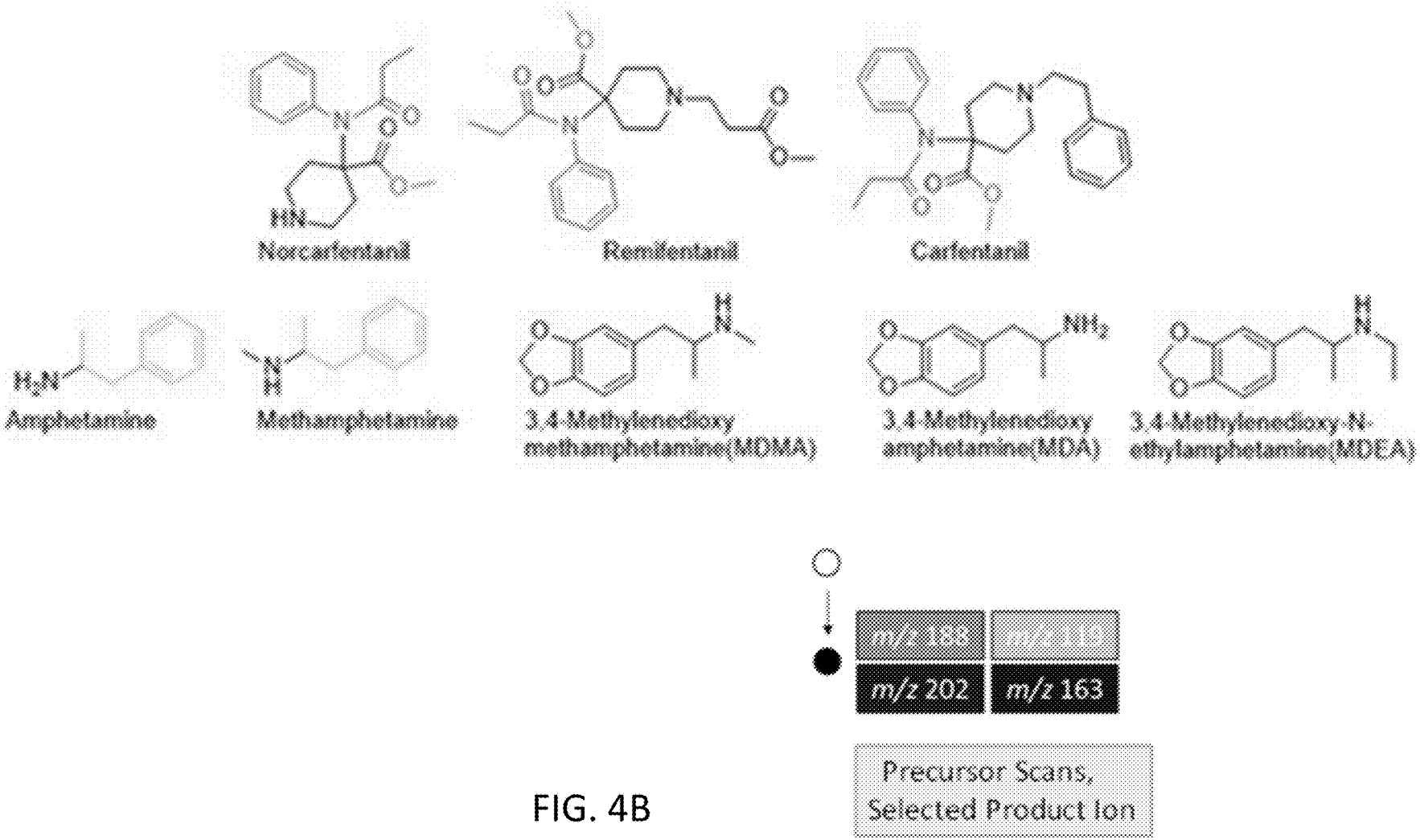

FIGS. 4A-B shows the structures of a number of fentanyl opioids as well as several characteristic neutral loss and precursor scans, color coded for the particular functional groups responsible. The Fentanyls subdivide into four classes based on C3 piperidine and other substituents.

Example 4: TRUE/FALSE Logical Operations

Figure 5:
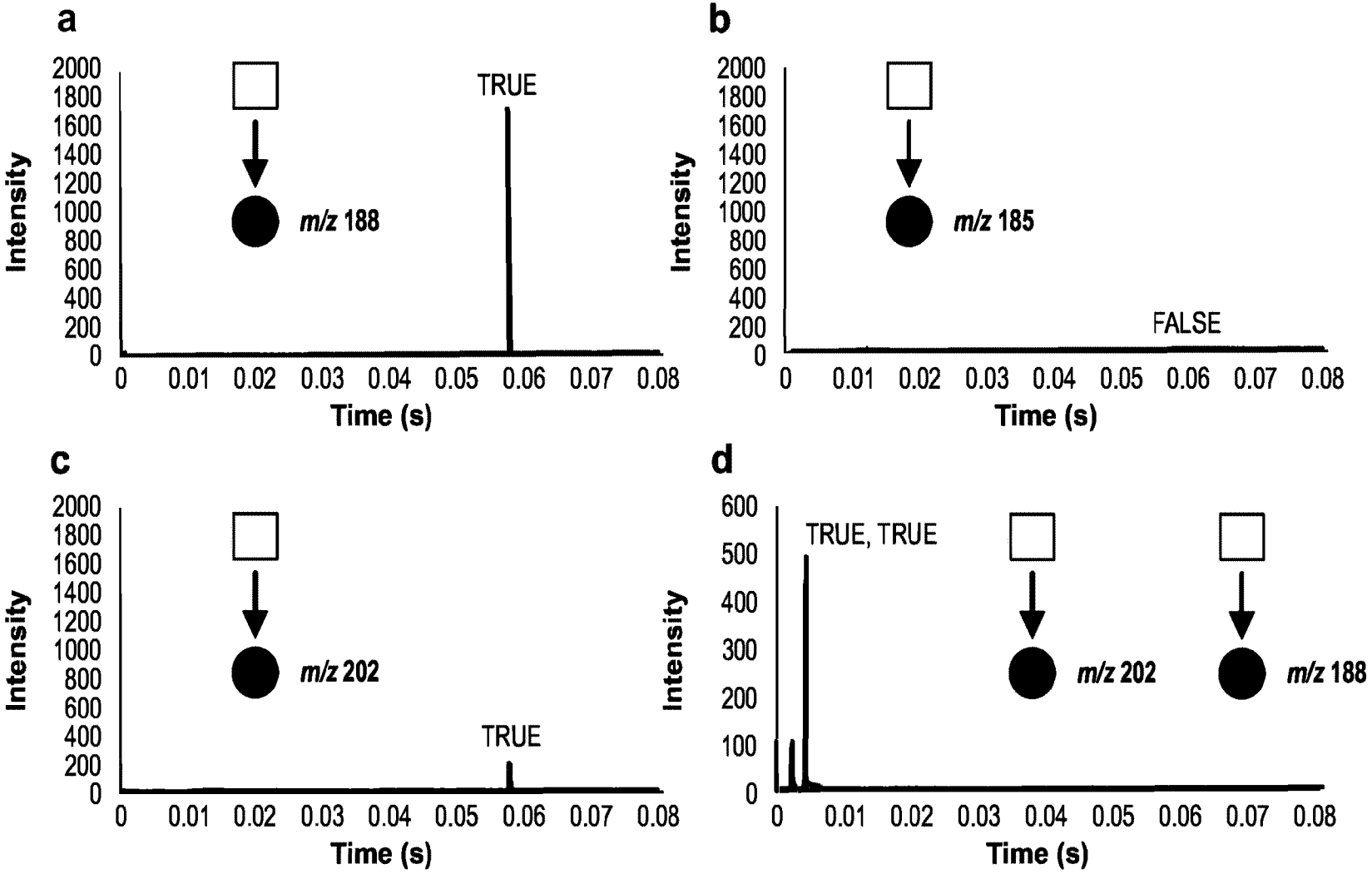
FIG. 5 panels A-D show fentanyl mixture (Cis-methyl fentanyl; butyryl fentanyl; fentanyl; acetyl fentanyl; sufentanil; acryl fentanyl; alfentanil; furanyl fentanyl) examined using broadband excitation, after which fixed frequency signals are applied to eject and detect the selected products to perform TRUE/FALSE scans.

FIG. 5 panels A-D show data and conclusions from several TRUE/FALSE logical operations. A TRUE/FALSE operation determines from a mixture whether there are any ions that fragment to one or more particular product ions, but, critically, the operation does not obtain the m/z of the precursor ions (such an implementation would be the well-known precursor ion scan). By interrogating all precursors without performing mass analysis and recording only the characteristic product, m/z 188 one can answer the yes/no question for phenethyl substituted fentanyls. A blank scan at m/z 185 shows the mass selectivity of the operation. A similar scan with product m/z 202 screens for methylated phenethyl substituted fentanyls. A simultaneous interrogation of all precursors (in a SWIFT experiment, or, similarly, using a sum of sine waves) and subsequent consecutive application of the resonant frequency of m/z 202 and then m/z 188 gives two back-to-back TRUE/FALSE scans. This spectrum answers the question OR though does not recover m/z from the precursors, unlike the OR/XOR/AND experiment demonstrated later.

Example 5: NOT/NOR Logical Operations

Figure 6:
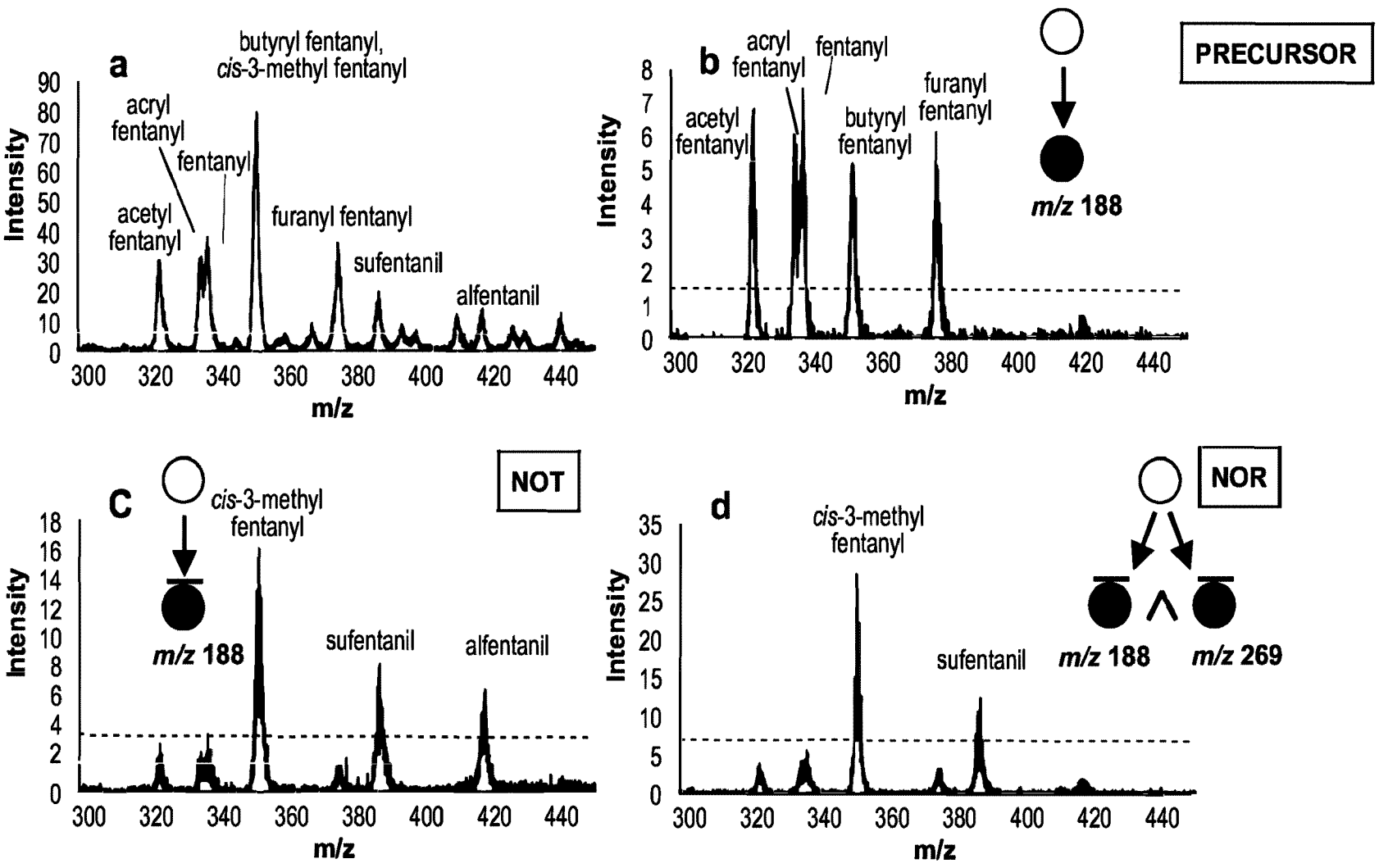
FIG. 6 panels A-D show fentanyl mixture (Cis-methyl fentanyl; butyryl fentanyl; fentanyl; acetyl fentanyl; sufentanil; acryl fentanyl; alfentanil; furanyl fentanyl) examined by (panel A) single stage MS (panel B) precursors of the phenethyl derived ion m/z 188, (panel C) the complementary NOT m/z 188 scan and (panel D) the NOR scan, viz. NOT m/z 188 and NOT m/z 269.

FIG. 6 panels A-D show precursor, NOT, and NOR scans for the same eight fentanyls (Cis-methyl fentanyl; butyryl fentanyl; fentanyl; acetyl fentanyl; sufentanil; acryl fentanyl; alfentanil; furanyl fentanyl). Panel A shows a full scan of the mixture. Briefly, a NOT scan records precursor ions that do not have a selected fragment ion or neutral loss, and the NOR scan records precursor ions that do not have either one of two selected fragment ions or neutral losses. All eight compounds are identified in the single stage MS, although one pair is isobaric. The precursor m/z 188 scan shows the five phenethyl substituted fentanyls. The NOT m/z 188 scan, performed by excluding in/z 188 from the ejected products, shows as expected three complementary fentanyls. Note that the other five fentanyls are detected in low abundance because they have low abundance product ions with m/z values not equaling 188 Th. The NOR scan, performed by excluding m/z 188 and 269 from ejection (note that only alfentanil produces product ion m/z 269), shows responses for cis-3-methyl fentanyl and sufentanil, neither of which can yield these fragments, the former because of methylation in the phenylethyl substituent, the latter because the thiophenethyl substituent occurs instead.

Figure 7:
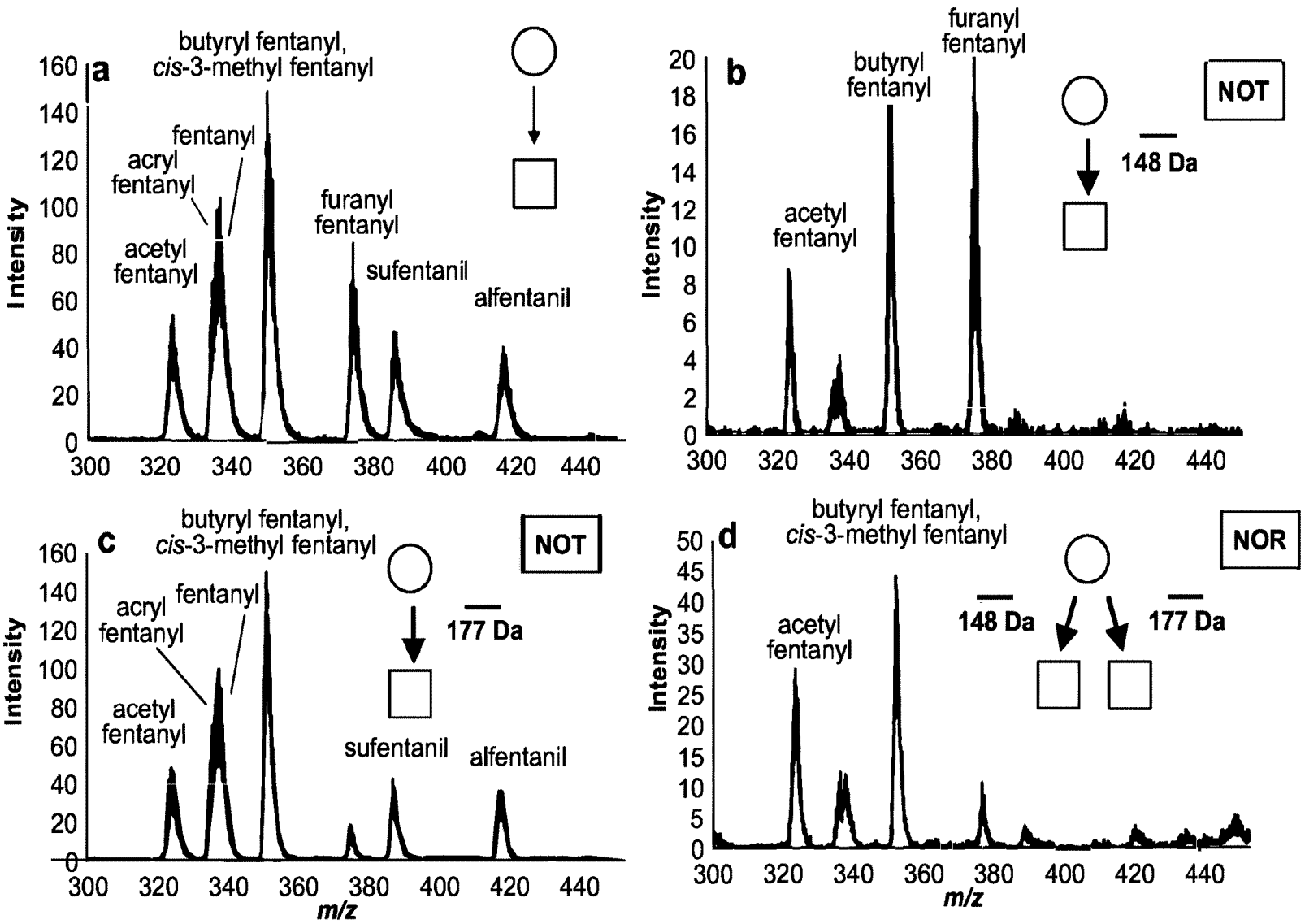
FIG. 7 panels A-D show fentanyl mixture (Cis-methyl fentanyl; butyryl fentanyl; fentanyl; acetyl fentanyl; sufentanil; acryl fentanyl; alfentanil; furanyl fentanyl) examined by (panel A) recording all products of MS/MS as precursor masses are scanned to give what appears to be a single stage MS (panel B) all fragments except those differing from precursor by 148 Da, recorded by scanning precursors and using a wide mass range SWIFT (or sum of sines) signal to eject products which are lower in mass while simultaneously ejecting neutral loss 148 Da product ions into the y electrodes to prevent their detection (panel C) all fragments except those differing from precursor by 177 Da, recorded the same way and (panel D) simultaneously neutralizing two sets of neutral loss product ions on the y electrodes to exclude detection of fragments that differ by 148 or 177 Da from their precursors.

Clearly, logical operations can easily be based on neutral loss scans as well as precursor scans, and on both. FIG. 7 panels A-D show examples of the use of NOT (neutral loss 148, so NOT phenethyl substituted fentanyls, NOT loss of 177 and hence not furanylethyl fentanyl (which is known to lose a neutral fragment of 177 Da, likely by rearrangement) and neither loss of 177 Da nor loss of 148 Da, viz. a NOR scan excluding all except acetyl-, butryl-, and cis-3-methyl fentanyl. Note the novel scan in panel (A) which appears to be a full scan but in fact records all precursor ions that fragment. In other words, the product ions are observed at the detector, not the precursor ions. Note also that it is not feasible to do the NL version of a NOT operation with a notched broadband (because the notch moves but the ion frequency doesn't). Instead the NL product ions are ejected into the y electrodes to exclude them from the detector. This alternative implementation could also be used for the NOT precursor ion scans but is not demonstrated here.

Example 6: Proposed Implementation on Triple Quadrupoles

This example illustrates triple quadrupole implementations of logical MS/MS operations (Table 2, column 3). For AND, OR, and XOR scans, the first quadrupole is scanned and q2 is used for fragmentation while Q3 is quickly switched between two selected product ion masses. 'And' and 'exclusive or' peaks can be distinguished since the two selected product ions are detected at different times (unlike the ion trap). A TRUE/FALSE operation is a precursor ion scan wherein Q1 is not scanned but instead operated in rf-only mode. Scans in which one or more product ions must be rejected in Q3 (NOR, NAND, etc.) while passing all other product ions are problematic. In these modes, Q3 must be operated rf-only to pass most product ions, and hence to reject selected product ions dipolar single or dual frequency waveforms must be used (on one or two pairs of electrodes). However, waveform methods have little precedence on transmission quadrupoles because the ions may not spend enough rf cycles in the device to be sufficiently rejected by the application of a waveform. Hence, only in cases with high rf frequencies and long rods will such methods be possible.

Example 7: Triple Resonance Excitation Methods for Improved Precursor and Neutral Loss Scans In the work, a triple resonance precursor scan is used to enhance sensitivity, selectivity, and molecular coverage. This work can be seen as an expansion of the previous experiment in which scans were operated simultaneously so that multiple product ions could be monitored at the same time (Dalton T. Snyder, Lucas J. Szalwinski, and R. Graham Cooks. Simultaneous and Sequential MS/MS Scan Combinations and Permutations in a Linear Quadrupole Ion Trap. Analytical Chemistry 2017, DOI: 10.1021/acs.analchem.7b03064). This work uses a second excitation frequency to selectively activate $MS^2$ product ions. This can be equated to performing $MS^3$ precursor ion scan in a single mass analyzer. We also present a method to differentiate between ions ejected at the stability boundary and ions resonantly ejected by the ac frequency. This provides a mechanism to increase the trapping voltage so ions can be excited much more selectively.

Introduction

Tandem mass spectrometry (MS/MS or $MS^n$) has been used in many fields in order to achieve higher sensitivity, selectivity, and specificity. Triple quadrupole mass spectrometers have been conventionally used for $MS^2$ experiments wherein the first and third quadrupole are used for mass analysis while the second quadrupole is used as a collision cell. Triple quadrupole mass spectrometers have been used in food, forensic, and environmental analysis. There are four main types of $MS^2$ scan modes typically used on triple quadrupole mass spectrometers. The first scan is product ion scanning in which a single precursor ion is selectively fragmented and the products are scanned for detection. The second scan is a precursor scan in which the precursor ions are scanned while a single product ion is monitored. If any of the precursors fragment to produce that product ion, a peak will appear. The third scan is a neutral loss scan, which is when both precursor and product ions are scanned for while keeping a constant mass offset. This allows for any precursor ion that loses a certain neutral loss to be detected. The final scan is called a multi reaction monitoring (MRM) and not truly a scan as neither the product nor precursor ion are scanned.

$MS^3$ experiments are common in typical ion trap product scanning in which ions are separated in a single analyzer over time. The incompatibility of precursor scans on an ion trap conventionally limit it to targeted data-dependent analysis. On the other hand, triple quadrupoles can perform precursor scan very efficiently by performing mass separation in space. Triple quadrupoles are unable to perform $MS^3$ scans because the instrument lacks enough mass analyzers to perform this operation. This operation is routinely performed on penta-quadrupole instruments due to the increased number of mass analyzers[32].

Experimental

Chemicals: All amphetamines, pheniramines, and phosphonates were purchased from Sigma-Aldrich (St. Louis, Mo., U.S.A.). These compounds were diluted in 50:50 methanol/water to concentrations ranging between 1-10 ppm. HPLC grade methanol was purchased from Fisher Scientific (Hampton, N.H., U.S.A.).

Instrumentation: All experiments were performed on a Finnigan LTQ linear ion trap mass spectrometer (San Jose, Calif., U.S.A.) previously modified to perform orthogonal excitation. A constant amplitude rf was generated by supplying a DC pulse (~190 mV, ~700 ms period, 90% duty cycle) to the rf amplifier. The ion trap has dimensions $x_0$=4.75 mm, $y_0$=4 mm, and three axial sections of lengths 12, 37, and 12 mm. The rf frequency was kept at 1.166 MHz. The ac waveforms were supplied by two Keysight 33612A arbitrary waveform generators. An inverse Mathieu q scan was calculated in Matlab in a manner which allowed the mass scale to be linearized with time.

Precursor scans were performed by using an inverse Mathieu q scan to excite ions in the y-dimension while ejecting out a particular ion by exciting a set frequency associated with its' secular frequency. A triple resonance excitation was performed by supplying an additional frequency in the y dimension corresponding to a particular $MS^2$ product ion's secular frequency. Neutral loss scans were performed by applying two inverse Mathieu q scans on orthogonal electrodes while triggering the ejection scan after to achieve a constant mass offset. A third inverse Mathieu q scan was applied to the same electrode used for excitation so that unfragmented precursor ions were removed before detection.

Beat frequencies were generated in precursor ion scan by summing two sine waves with a frequencies different by the desired beat frequency with the lower frequency corresponding to the secular frequency of the product ion. In the neutral loss scan mode, beat frequencies were generated by summing two inverse Mathieu q scans with one of the scans having a constant frequency offset corresponding to the desired beat frequency.

Results and Discussion

Orthogonal excitation using frequency sweeps on a linear quadrupole ion trap allowed scans capable typically limited to triple quadrupoles to be implemented on a linear quadrupole ion trap. In the ion trap experiment two different excitation waveforms can be used on orthogonal electrodes to fragment and eject ions linearly with time so that detection of these product ions can be correlated with the precursor ion. In the neutral loss scan mode, the second waveform is offset in time from the first so that a neutral loss between precursor and product can be detected. In the precursor scan mode, the second waveform has a fixed frequency corresponding to the product ion's secular frequency.

Figure 8:
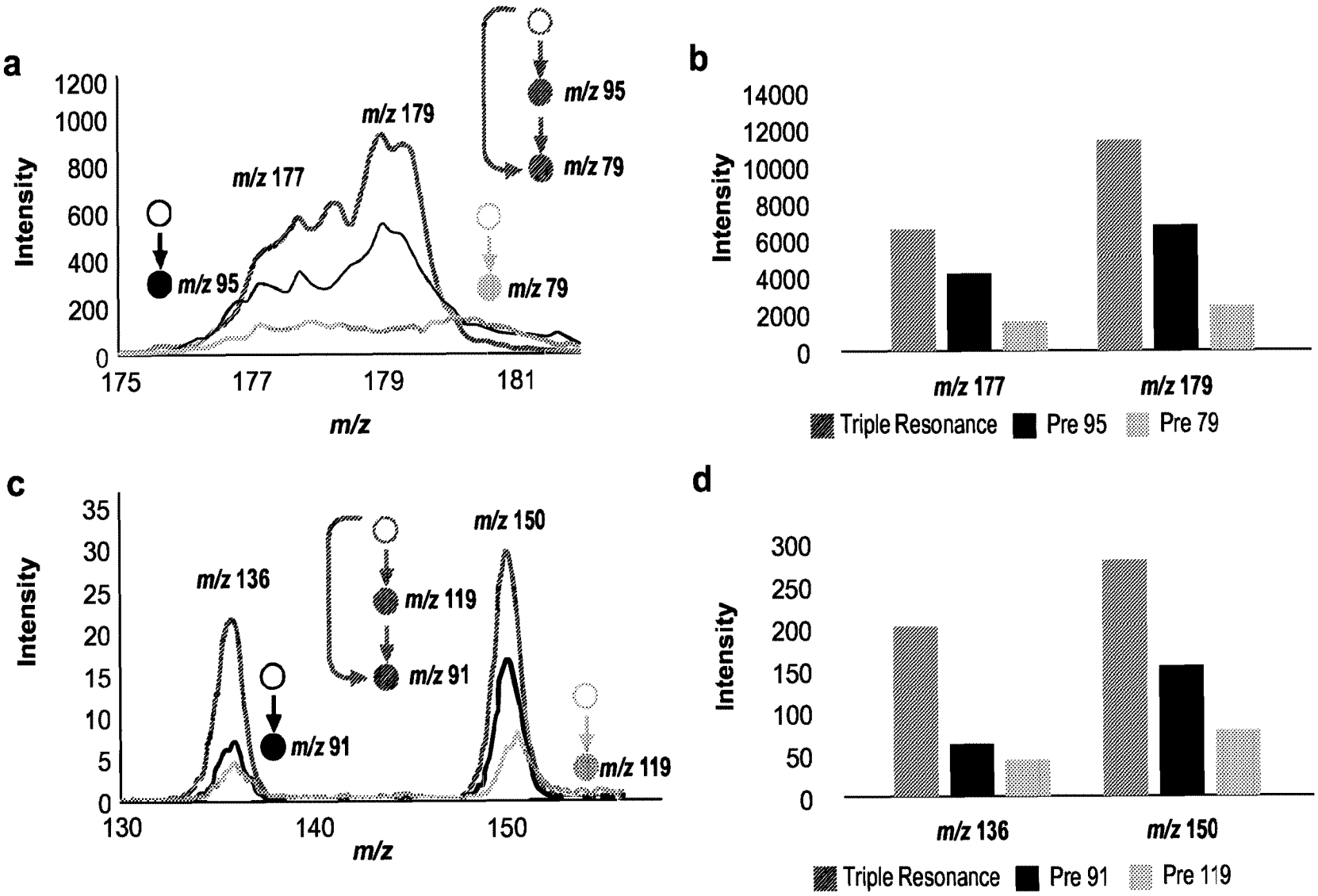
FIG. 8 panels A-D show Increased sensitivity in the detection of chemical warfare agent simulants in negative ion mode (cyclohexyl methylphosphonate and pinacolyl methylphosphonate, m/z 177 and 179 respectively, both (M−H)−) and amphetamines in positive ion mode (amphetamine and methamphetamine m/z 136 and 150 respectively, both (M+H)+) (panel A) Overlaid mass spectra of precursor ion scan of m/z 95 (brown), precursor ion scan of m/z 79 (orange), and triple resonance precursor scan of m/z 79 with a second resonance on the frequency corresponding to m/z 95 (red). (panel B) integrated signal intensities of m/z 177 and 179 using various precursor ion scans. (panel C) overlaid mass spectra of precursor ion scan of m/z 91 (brown), precursor ion scan of m/z 119 (orange), and triple resonance precursor scan of m/z 91 with a second resonance on the frequency corresponding to m/z 119 (red). (panel D) integrated signal intensity of m/z 136 and 150 using various precursor ion scans.

Triple resonance precursor excitation is a simple modification to an existing frequency precursor scan to increase selectivity and sensitivity. This is accomplished by applying the sum of two waveforms on the y-electrode, one which is a non-linear frequency sweep and the other being a fixed frequency associated with a selected product ion. This combination of waveforms allows for detection of product ions not normally very abundant in a $MS^2$ experiment, but are abundant in a $MS^3$ experiment. The increased sensitivity can be seen when performing a precursor scan of chemical warfare agent simulants (FIG. 8 panel A). When performing either individual precursor scan for m/z 95 or 79, the signal intensity is much less than when a triple resonance precursor scan is performed to excite m/z 95 and detect m/z 79. A second case is presented of increased sensitivity (FIG. 8 panel C) in which two amphetamines are subjected to a triple resonance precursor scan. The signal intensity of precursor scan 91 increases when an additional frequency is applied to the y-electrode corresponding to m/z 119. This increased sensitivity can be attributed to the reduction in available states the product ions could reside in, specifically the products of fragmentation from a $MS^2$ product ion produce a single product ion also produced in the $MS^2$ scan. This case is not universal as not all $MS^2$ product ions fragment to a stable $MS^3$ product.

Figure 9:
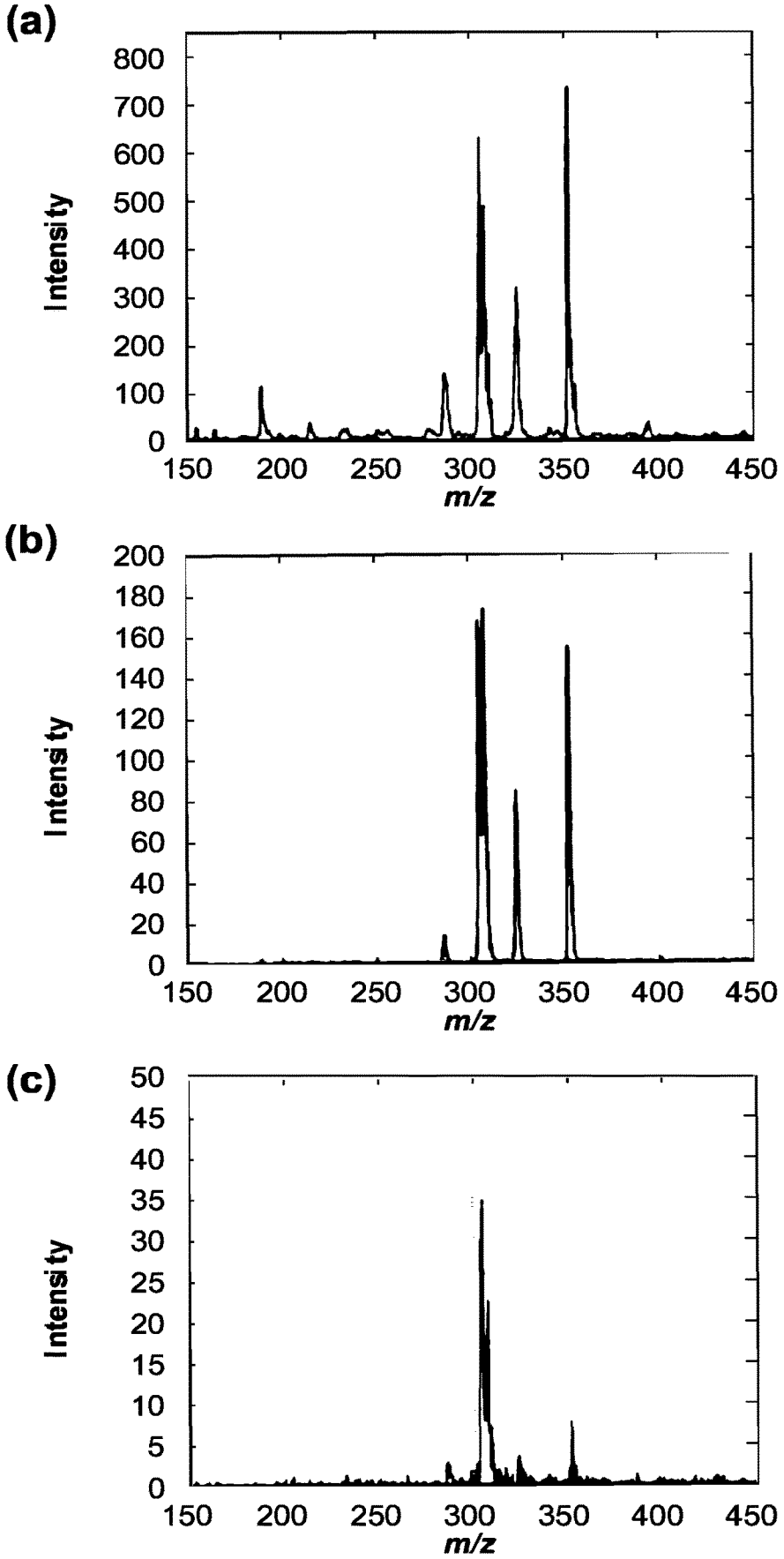
FIG. 9 panels A-C show increased selectivity in the detection of various opioids (panel A) Full scan of a mixture containing hydromorphone (m/z 286), cocaine (m/z 304), cocaine-d3 (m/z 307), acetyl fentanyl (m/z 323), and butyryl fentanyl (m/z 351). (panel B) Precursor scan of m/z 188 (panel C) Triple resonance precursor scan of m/z 150, in which a frequency sweep and a single frequency associated with m/z 188 are applied on the y-electrode and a single frequency applied on the x-electrode associated with m/z 150 (a fragment of m/z 182, which is the cocaine and cocaine-d3 fragment detected in panel B).

An inherent issue in complex mixture analysis by tandem mass spectrometry is the detection of unrelated precursor ions that fragment to the same $MS^2$ product as the desired compound class. This can be overcome by targeting a product ion generated by $MS^2$ of the desired compound, but not in unrelated analytes. A five compound mixture with analytes that produce fragments within 6 Th of 188 Th were subjected to a precursor scan of m/z 188 (FIG. 9B). A triple resonance precursor scan of m/z 150 was then used to separate product ions of the precursor scan of m/z 188 (FIG. 9C). This was accomplished by applying a fixed frequency corresponding to m/z 188 to the y-electrodes during a precursor scan of m/z 150. Although selectivity is increased, signal intensity decreases as a function of fragmentation efficiency.

Figure 10:
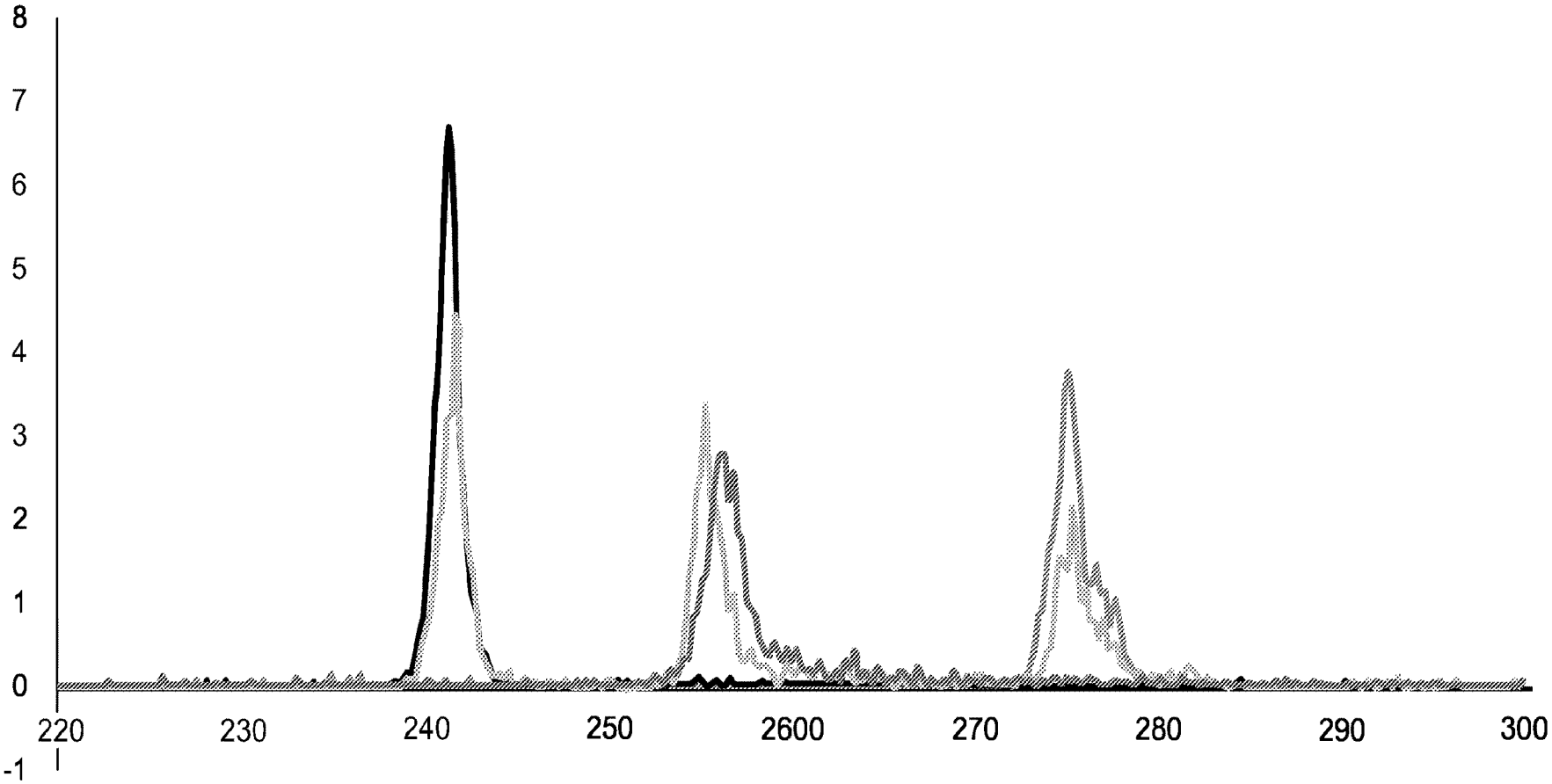
FIG. 10 shows increased molecular coverage of ions that have similar $MS^2$ and $MS^3$ products. Overlaid spectra of various precursor ion scans of a mixture containing pheniramine (m/z 241), diphenhydramine (m/z 256), and chlorpheniramine (m/z 275). Precursor ion scans of m/z 196, 167, and 246 are shown as red, purple, and blue respectively. A triple resonance precursor ion scan shown in green applies two fixed frequencies corresponding to m/z 196 and 246 for further fragmentation while a fixed frequency associated with m/z 167 is used to eject product ions with m/z 167.

Molecular coverage can be increased using these triple resonance precursor scans by reducing the number of individual scans required to integrate for the same number of targets (FIG. 10). Specifically, molecules that do not all fragment to the same $MS^2$ products, but they do fragment to the same $MS^3$ fragment can be detected in the same precursor scan. This reduction of scans is demonstrated with pheniramines, where 3 different pheniramines produce 3 different major product ions. A triple resonance precursor scan was used to fragment the major product ions produced by 2 of the precursor ions while ejecting out a frequency associated with the shared product ions mass to charge. This would reduce the number of required scans to obtain the same information.

A shortcoming of using a single analyzer for fragmentation and detection is that ions who are trajectory is unstable are boundary ejected are detected. This presents a challenge as product ions ejected below the mass cutoff are detected in the same manner as resonantly ejected ions. This creates artifact peaks in the mass spectrum. These can be subtracted by scanning without the ejection waveform and seeing which ions are being ejected by boundary ejection and then scanning with the ejection waveform. This solution to scan twice is not ideal. Another solution is to detect the frequency of ions at the detector. Ions which are excited at their secular frequency will oscillate with that frequency creating packets of ions. Ions ejected due to being unstable and are ejected at the boundary will have a frequency of half of the trapping frequency. This frequency of packets is typically not seen in the mass spectrum as the detector typically has a much lower scan rate than the ions secular frequency, typically between 100-450 kHz for a 1.1 MHz trapping field. This produces spectra with a seemingly continuous ion current. If the detectors could scan at a much faster rate, the ejection method could be determined.

Figure 3A:
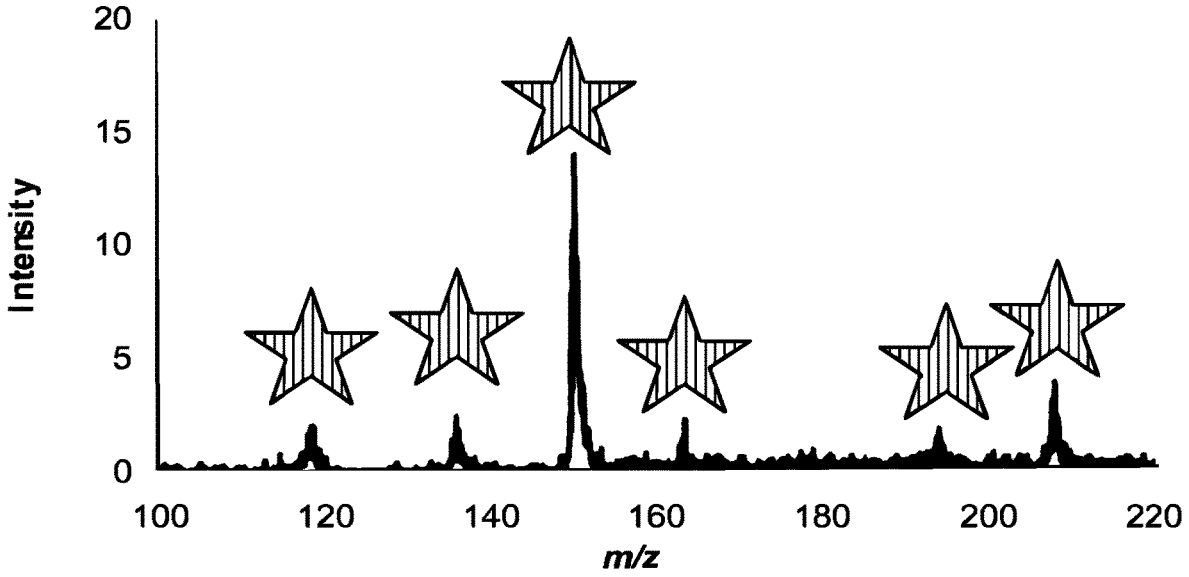
FIGS. 3A-H show beat frequency resonance ejection of peaks composed of both boundary instability and resonance ejection.
Figure 3B:
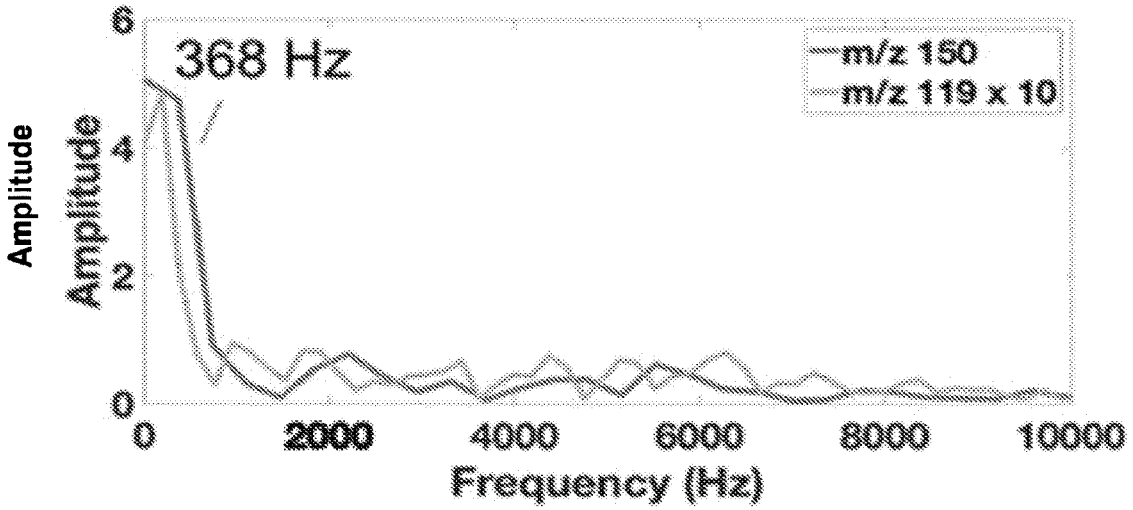
Figure 3C:
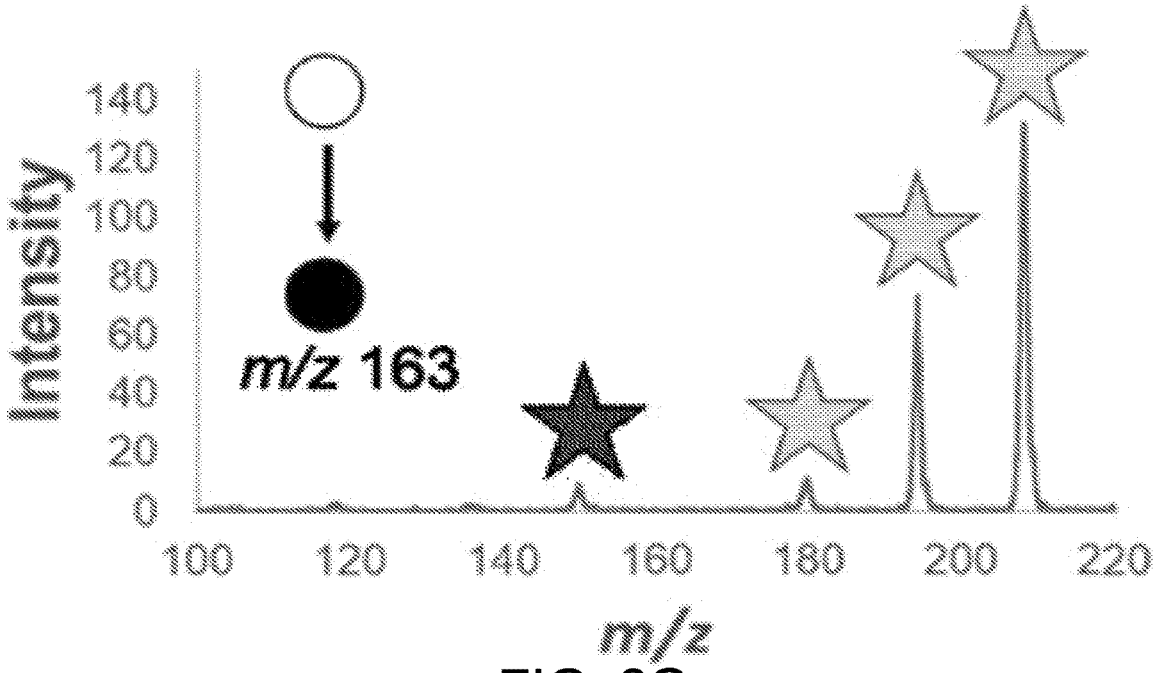
Figure 3D:
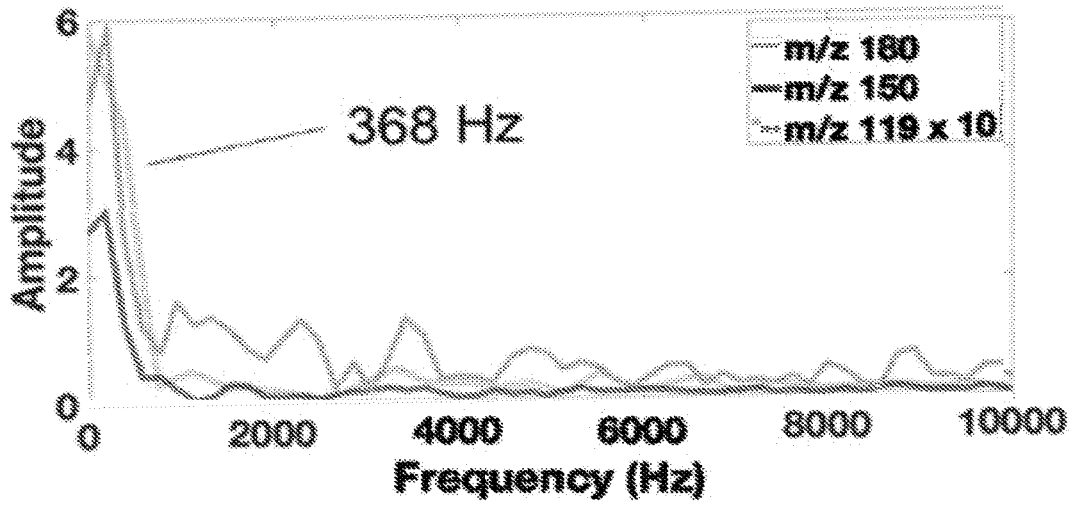
Figure 3E:
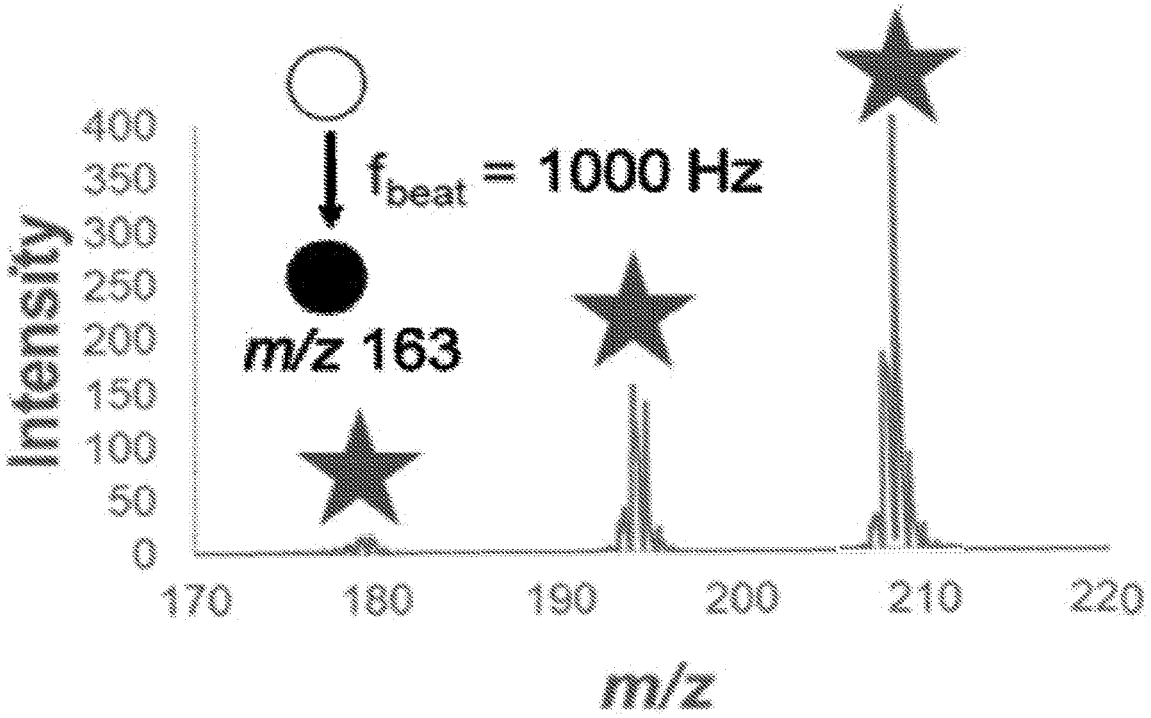
Figure 3F:
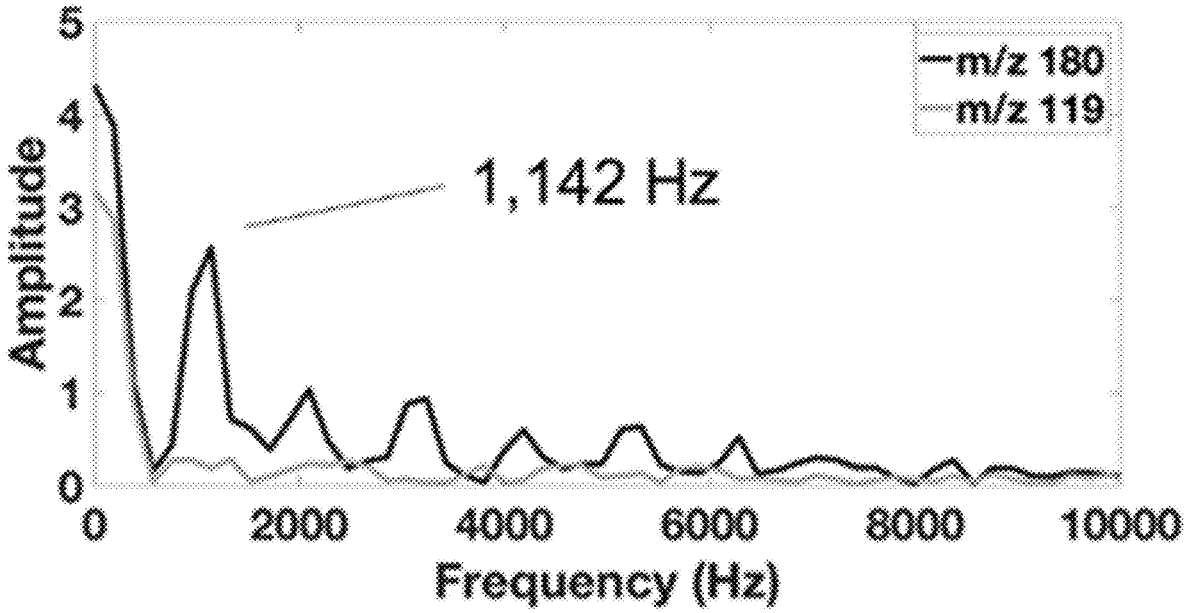
Figure 3G:
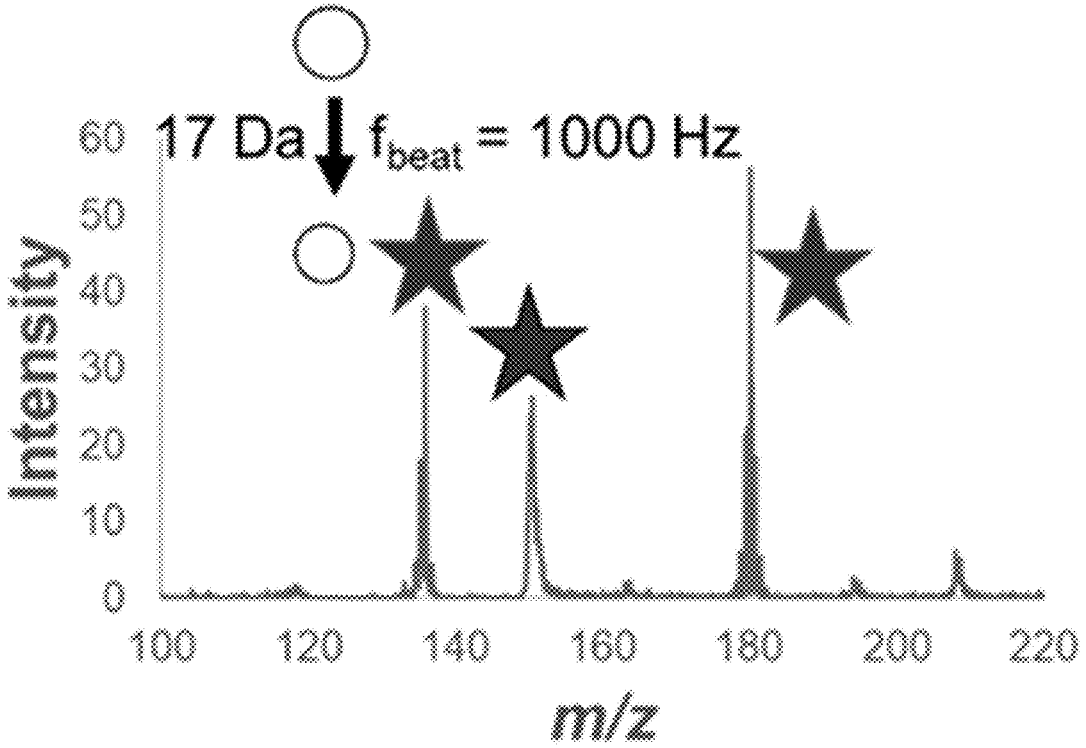
Figure 3H:
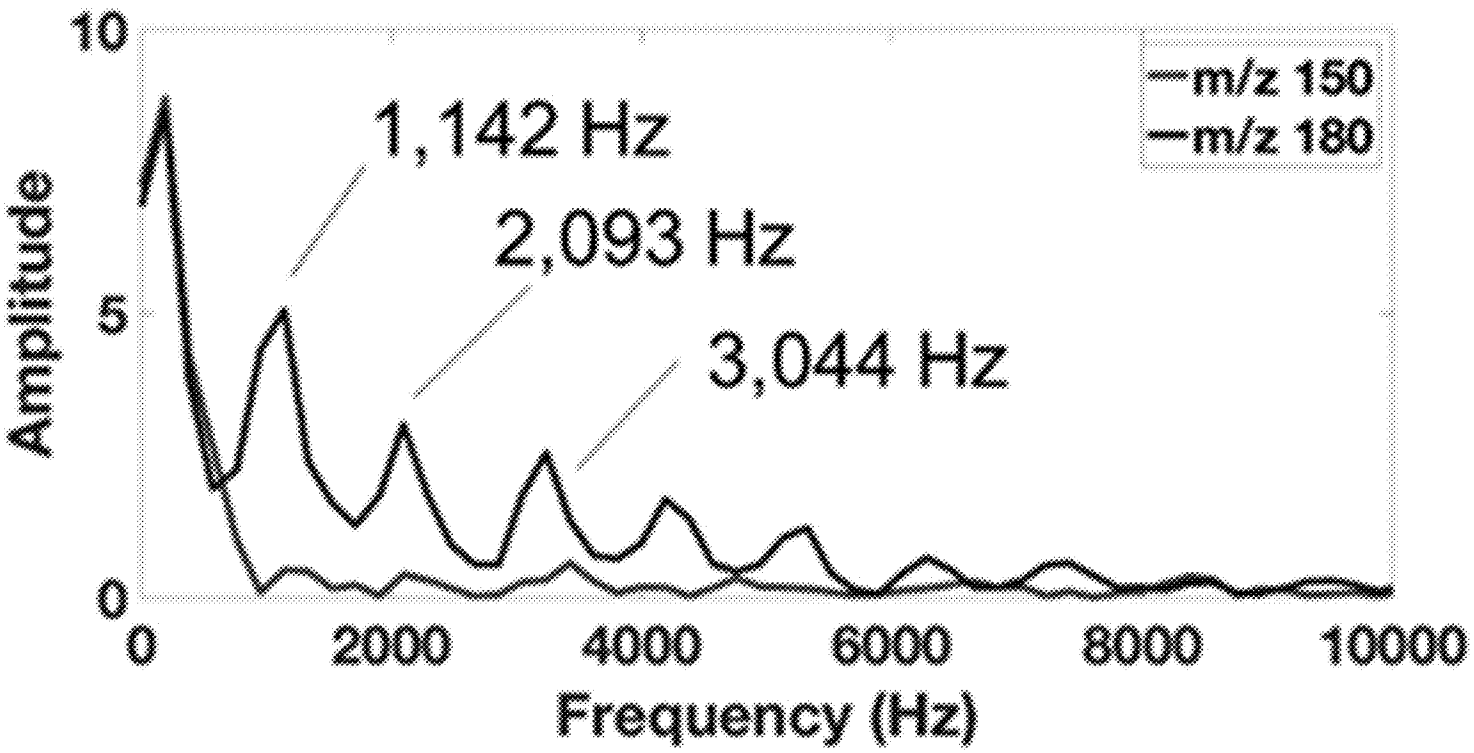

Another solution besides making the detector scan faster is to make the ions eject out with a lower frequency. This could be done by lowering the ions secular frequency below the detector's scan rate by changing the trapping rf. This would generate more problems than it solved. A more elegant solution is to encode the ions m/z with a secondary frequency, one which cannot be observed in boundary ejected ions. This can be done by creating a 'beat' in the ac frequency. Ions would then be ejected with a frequency that is the sum of the secular frequency and this beat frequency. Since the detector is unable to see frequencies greater than its scan rate, only the beat frequency would be observed. The beat frequency is generated by summing two waveforms offset by a set frequency that corresponds to the beat frequency. For example, the summation of two sine waves with a frequency of 250 and 251 kHz would produce a beat of 1 kHz. FIGS. 3A-H demonstrate this solution to identifying artifact peaks. First, 5 amphetamines were trapped in a manner that the low mass cutoff (LMCO) was 92 Th. These 5 amphetamines all produce a product ion below this LMCO even when no ejection frequency is applied. These products would be detected and show up as artifacts in a single analyzer precursor scan (FIG. 3A). In this scan the precursor ions were excited as a function of time so that the only peaks observed should be artifacts from boundary ejection. Note that all peaks labelled with a red star are purely artifacts from boundary ejection. Blue peaks are due to pure resonance ejection (the desired process), and purple peaks have contributions from both. A fast Fourier Transform (FFT) of any one of the boundary ejection peaks generates a spectrum in which a single peak below 400 Hz is observed (FIG. 3B). The 400 Hz corresponds approximately to the resolution of the peak in time. An ejection frequency can then be applied to eject product ions with a known secular frequency (FIG. 3C). A FFT of each of these peaks generates 3 identical spectra with a single peak below 400 Hz (FIG. 3D). These two ejection methods cannot be differentiated in either scan, but when the ac frequency is applied with a beat frequency, this beat can be seen in the mass spectrum (FIGS. 3E and G) but only for the resonantly ejected ions. The peak shape changes drastically, and by performing a FFT of one of the peaks allows for the beat frequency to be identified (FIGS. 3F and H). The FFT results in a peak with a frequency slightly greater than the applied beat frequency. Harmonics can also be seen in the FFT.

Figure 11:
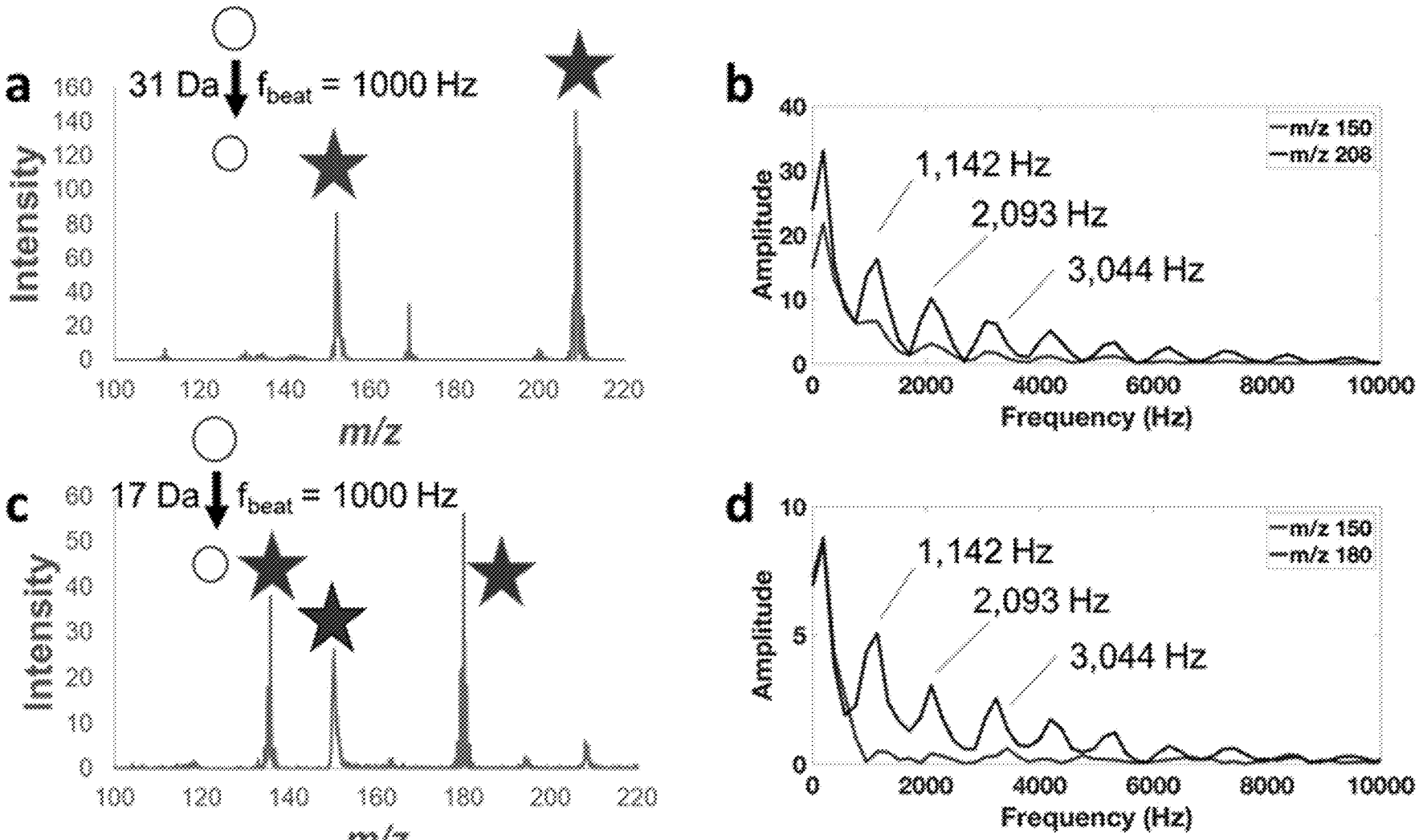
FIG. 11 panels A-D show beat frequency resonance ejection in neutral loss scanning; constant frequency offset variant. (panel A) Beat frequency neutral loss scan of 31 Da at constant frequency offset of 1,000 Hz and (panel B) peak FFTs, and (panels C, D) the same for a neutral loss scan of 17 Da. In (a) m/z 150 is part artifactual and so is modulated by the beat frequency but in (panel C) it is entirely an artifact and hence not modulated.

This beat frequency is not only unique to precursor ion scans. Neutral loss scans, in which the product ion is a constant m/z lower than the precursor ion, can have a beat frequency added to it by summing two frequency sweeps with a constant frequency offset. This resultant frequency is applied with a slight offset to the excitation frequency sweep. FIG. 6 actualizes this result. FIG. 11 panel A presents a case in which the ejection for a particular ion is not wholly attributed to one method. Fragmentation of m/z 150 produces some product ions below the LMCO (91 Th) and a product ion with m/z 119, a neutral loss of 31. The contributions from both of these products can be attributed to the fragmentation efficiency of each of these product ions. A neutral loss scan of 17 Da of the same solution will identify both ions that lose 17 Da as well as ions that produce product ions below the LMCO. Identification of distorted peak shapes as well as taking the FFT of individual peaks allows for each ion's ejection method to be identified.

Figure 12:
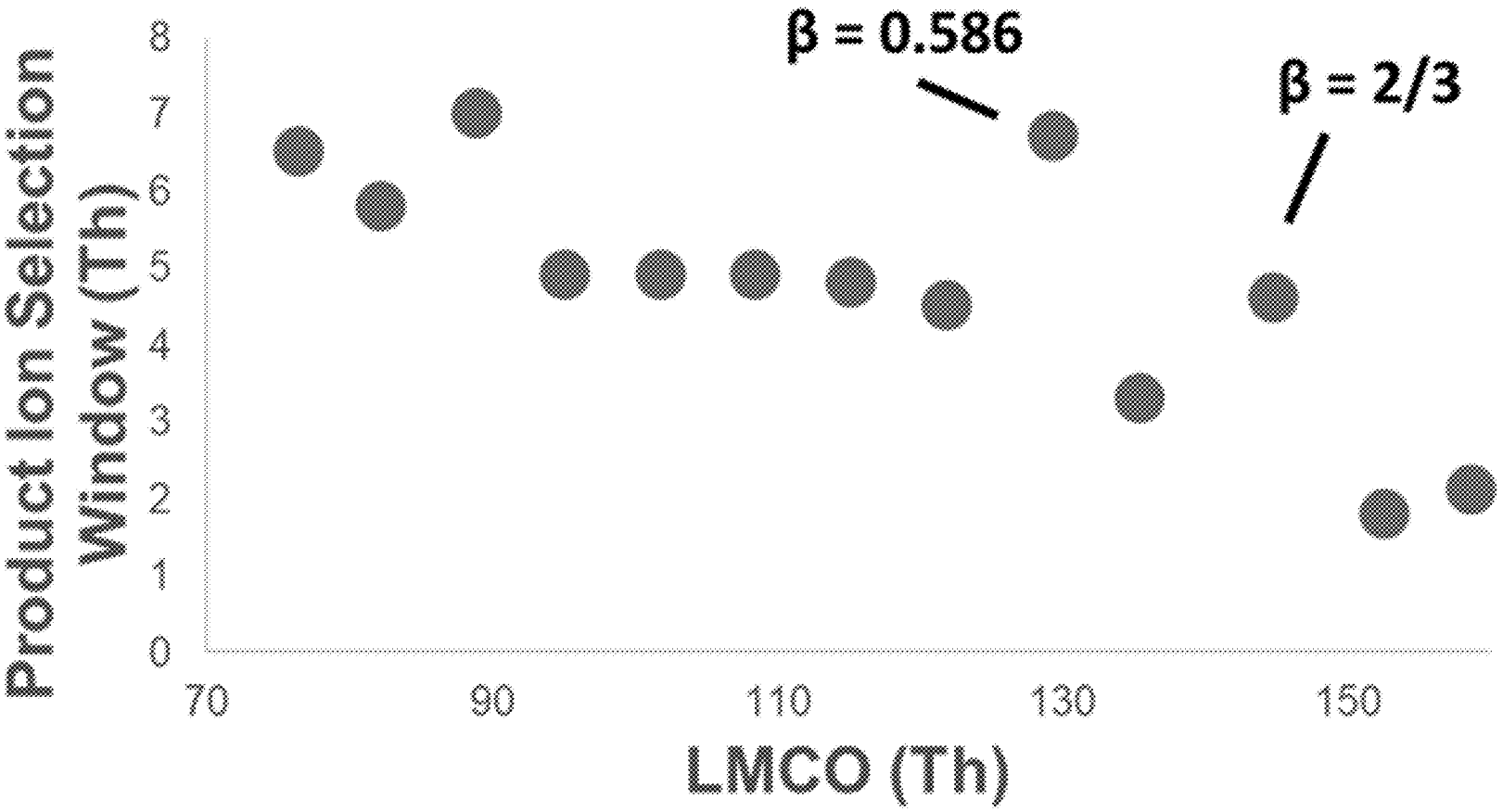
FIG. 12 shows product ion selection window (FWHM) of the precursor ion scan of m/z 163 as a function of LMCO (proportional to the rf voltage) for a set of amphetamine precursor ions that fragment to m/z 163. Labels correspond to scans wherein m/z 163's working point was on or near a nonlinear resonance line.

The capability to determine the ejection method allows for the trapping voltage to be increased. This allows for an individual ion to be placed at a higher q value. This is beneficial as there is more secular frequency dispersion at higher q values. Two ions different by 1 m/z will have a larger difference in secular frequencies. This allows for much higher selectivity in selecting a precursor ion. A precursor scan for m/z 163 was used to identify the m/z range in which the product ion is excited for ejection (FIG. 12). Non-linear resonance lines can be identified at beta=2/3 and beta=0.586, which correspond to non-linear resonance lines[35].

CONCLUSION

Triple resonance precursor scans provide increased selectivity as well as improved sensitivity for cases where a precursor ion fragments to two product ions, one of which fragments to the other. Triple resonance precursor scans also increase molecular coverage by fragmenting various precursor ions containing a similar structural motif that each precursor ion fragments too. A beat frequency can also be applied to determine how the product ion was ejected.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. A system comprising:

a mass spectrometer comprising a single ion trap; and a central processing unit (CPU), and storage coupled to the CPU for storing instructions that when executed by the CPU cause the system to apply a plurality of scan functions to the single ion trap in a manner that the single ion trap conducts ion analysis that is conducted in a triple quadrupole mass spectrometer, while causing the system to also apply a beat frequency to the single ion trap to identify artifact peaks in a generated mass spectrum.

2. The system according to claim 1, wherein the plurality of scan functions applied to the single ion trap cause the single ion trap to conduct a triple resonance precursor scan.

3. The system according to claim 2, wherein the triple resonance precursor scan comprises an inverse Mathieu q scan applied to the single ion trap in a y-dimension and an additional frequency applied to the single ion trap in the y-dimension corresponding to a particular MS' product ion's secular frequency.

4. The system according to claim 2, wherein the instructions, wherein executed by the CPU, further the system to apply a beat frequency in the triple resonance precursor scan.

5. The system according to claim 4, wherein the beat frequency is generated by summing two sine waves with frequencies different by a desired beat frequency with a lower frequency corresponding to a secular frequency of a product ion.

6. The system according to claim 1, wherein the plurality of scan functions applied to the single ion trap cause the single ion trap to conduct a neutral loss scan.

7. The system according to claim 6, wherein the neutral loss scan comprises applying two inverse Mathieu q scans on orthogonal electrodes of the single ion trap to excite precursor ions and then neutralize the precursor ions while triggering a broadband sum of sines to eject all product ions of the excited precursor ions.

8. The system according to claim 7, wherein a third inverse Mathieu q scan is applied to the orthogonal electrodes used for excitation so that particular product ions satisfying a selected neutral loss are removed before they are detected.

9. The system according to claim 7, wherein a plurality of additional inverse Mathieu q scans are applied to the orthogonal electrodes used for excitation so that at least two particular product ions satisfying selected neutral losses are removed before they are detected.

10. The system according to claim 6, wherein the instructions, wherein executed by the CPU, further cause the system to apply a beat frequency in the neutral loss scan.

11. The system according to claim 10, wherein the beat frequency is generated by summing two inverse Mathieu q scans with one of the inverse Mathieu q scans having a constant frequency offset corresponding to a desired beat frequency.

* * * * *